US007347493B2

(12) United States Patent
Mulmed

(10) Patent No.: US 7,347,493 B2
(45) **Date of Patent: *Mar. 25, 2008**

(54) COMPOSITE ASSEMBLY OF INTERCONNECTABLE FURNITURE

(75) Inventor: Theresa A. Mulmed, Scottsdale, AZ (US)

(73) Assignee: Dodaz, Inc., Scottsdale, AZ (US)

( * ) Notice: Subject to any disclaimer, the term of this patent is extended or adjusted under 35 U.S.C. 154(b) by 389 days.

This patent is subject to a terminal disclaimer.

(21) Appl. No.: 11/059,211

(22) Filed: Feb. 15, 2005

(65) Prior Publication Data

US 2006/0180055 A1 Aug. 17, 2006

(51) Int. Cl.

| | |
|---|---|
| ***A47C 15/00*** | (2006.01) |
| ***A47C 7/02*** | (2006.01) |
| ***A47C 7/40*** | (2006.01) |
| *A47C 7/28* | (2006.01) |

(52) U.S. Cl. ..... 297/233; 297/248; 297/452.52; 297/452.63

(58) Field of Classification Search ..... 297/248, 297/233, 440.14, 232, 452.63, 452.52, 452.53; 5/491, 492, 643

See application file for complete search history.

(56) References Cited

U.S. PATENT DOCUMENTS

| | | | | | |
|---|---|---|---|---|---|
| 571,000 | A | * | 11/1896 | Jackson | 297/117 |
| 691,134 | A | * | 1/1902 | Gully | 5/491 |
| 793,476 | A | * | 6/1905 | Van Duzer | 5/491 |
| 931,106 | A | * | 8/1909 | Westmore | 297/452.52 |
| 995,277 | A | | 6/1911 | Mueller | |
| 1,900,474 | A | | 3/1933 | Wilson | |
| 1,961,457 | A | * | 6/1934 | Schnelder | 297/121 |
| 2,145,201 | A | | 1/1939 | Raeuber | |
| D143,454 | S | | 1/1946 | White | |
| 3,030,146 | A | | 4/1962 | Faxon | |
| 3,183,036 | A | | 5/1965 | Hill | |
| 3,563,599 | A | | 2/1971 | Heumann | |
| 3,606,461 | A | * | 9/1971 | Moriyama | 297/451.8 |
| 3,608,101 | A | | 9/1971 | Castro et al. | |
| 3,658,381 | A | | 4/1972 | Grant, Sr. | |
| 3,729,229 | A | * | 4/1973 | Minsker | 297/440.13 |
| 3,811,728 | A | | 5/1974 | Redemske | |
| 3,822,078 | A | | 7/1974 | Spadolini | |
| 3,955,850 | A | * | 5/1976 | Toso | 297/440.14 |
| 4,046,421 | A | * | 9/1977 | Spound et al. | 297/232 |
| 4,077,666 | A | * | 3/1978 | Heumann | 297/440.14 |
| 4,235,039 | A | | 11/1980 | Brooks | |

(Continued)

*Primary Examiner*—David Dunn
*Assistant Examiner*—Tania Abraham
(74) *Attorney, Agent, or Firm*—Robert D. Atkins; Quarles & Brady LLP

(57) ABSTRACT

A composite assembly of furniture units each have a solo utilization, which can be seating surface area or table top surface area. The furniture units are made with an irregular contoured surface. When the irregular surface of a first furniture unit is brought in proximity to the irregular surface of a second furniture unit, the composite assembly assumes a joint utilization which differentiates from the solo utilization of the furniture units. The joint utilization of the composite assembly enlarges seating surface area or the table top surface area over the solo utilization. The furniture units are versatile because each can be used in its solo configuration or combined into the composite assembly for other uses. A mechanical coupling mechanism is used to secure the furniture units in the composite assembly configuration. The mechanical coupling can be a latch, magnetic plate, bracket, or rod.

25 Claims, 19 Drawing Sheets

U.S. PATENT DOCUMENTS 4,321,873 A * 3/1982 Nealis ..... 108/91
4,523,787 A 6/1985 Robinson
4,632,459 A 12/1986 Herschlag
4,711,495 A 12/1987 Magder
4,995,668 A * 2/1991 Zivari ..... 297/248
5,096,258 A * 3/1992 Mestre Boix ..... 297/233
5,267,776 A * 12/1993 Fromson ..... 297/232
5,308,146 A * 5/1994 Chou ..... 297/440.16
5,318,340 A 6/1994 Henry
5,335,962 A * 8/1994 Gera ..... 297/232
5,339,747 A 8/1994 Epps
5,470,128 A * 11/1995 Kerkham ..... 297/232
5,601,340 A 2/1997 Stout
5,630,644 A * 5/1997 LaPointe et al. ..... 297/232
5,848,821 A * 12/1998 Kirby ..... 297/232
5,865,501 A 2/1999 Eisengberg et al.
5,992,938 A 11/1999 Jones
6,102,475 A * 8/2000 Hamann ..... 297/172
6,106,058 A 8/2000 Sur et al.
6,174,026 B1 1/2001 Wise
6,296,314 B1 10/2001 Klein
6,331,033 B2 * 12/2001 Lau ..... 297/325
6,338,528 B1 * 1/2002 Lohness et al. ..... 297/248
6,367,880 B1 4/2002 Neiderman et al.
6,454,358 B1 * 9/2002 Benincasa ..... 297/440.14
6,543,845 B2 * 4/2003 Seitz et al. ..... 297/248
6,715,837 B2 4/2004 Neiderman et al.
6,739,670 B2 5/2004 Johnson
6,824,220 B1 * 11/2004 Davison ..... 297/440.14
6,827,407 B2 12/2004 Niederman et al.
6,931,676 B1 * 8/2005 Henley, Jr. ..... 5/53.1
6,932,428 B2 * 8/2005 Murphy ..... 297/248
7,014,267 B1 * 3/2006 Nagar ..... 297/440.14
7,020,911 B2 4/2006 Oldham
7,020,919 B2 * 4/2006 Inaba ..... 5/638
7,237,845 B2 * 7/2007 Mulmed ..... 297/440.14

* cited by examiner

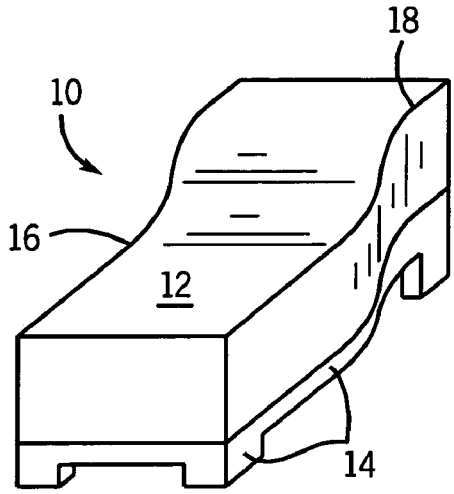
FIG. 1a
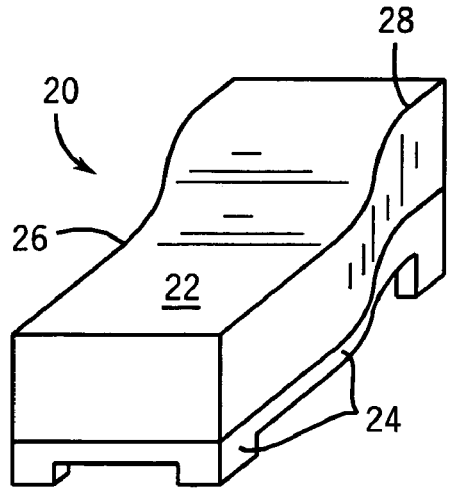
FIG. 1b
FIG. 2
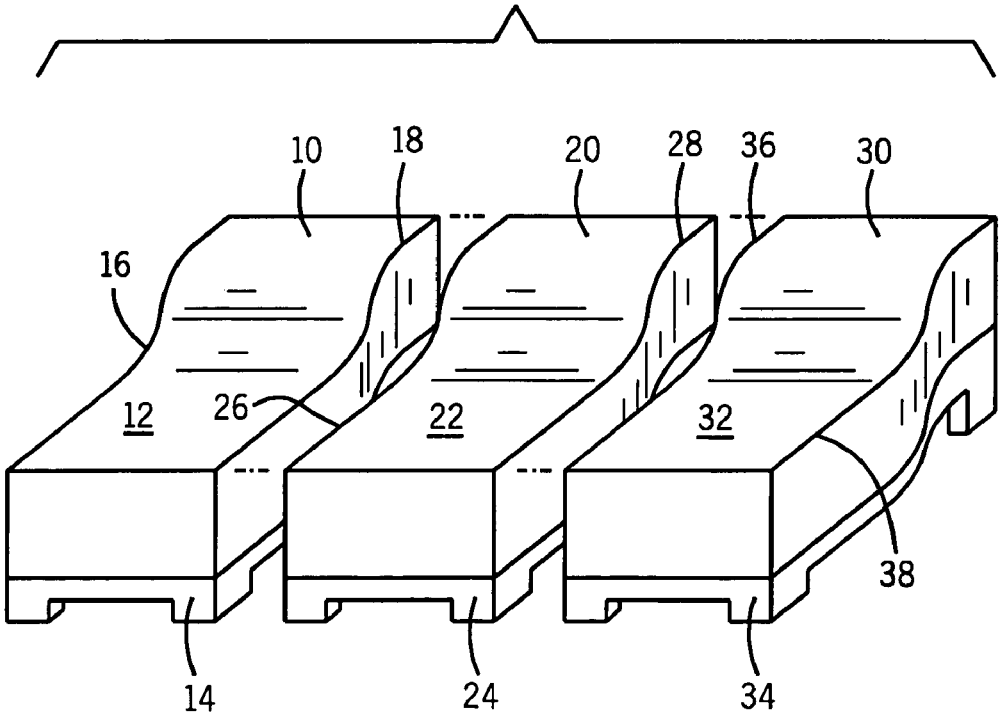

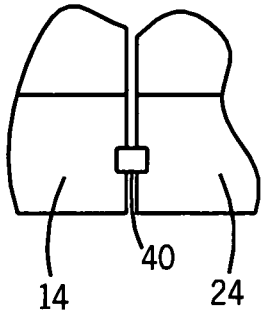
FIG. 3a
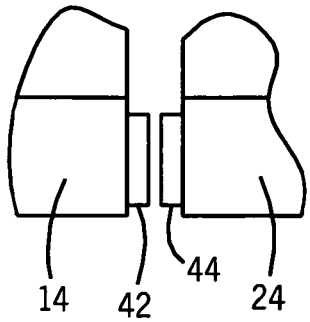
FIG. 3b
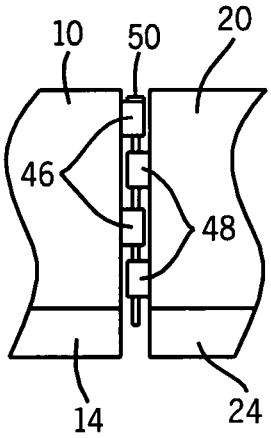
FIG. 3c
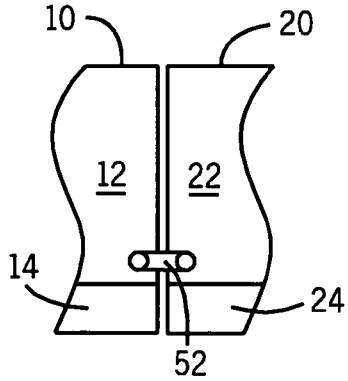
FIG. 3d
FIG. 3e
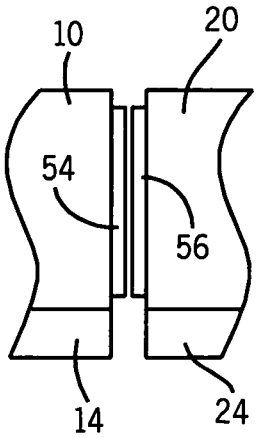

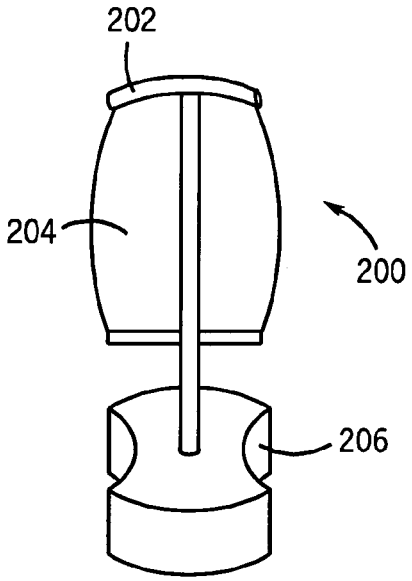
FIG. 14a
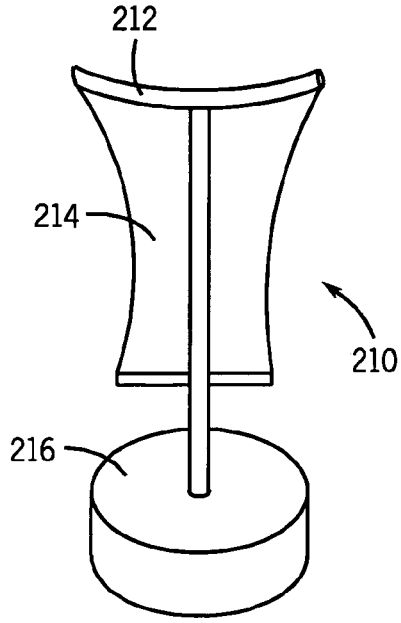
FIG. 14b
FIG. 15
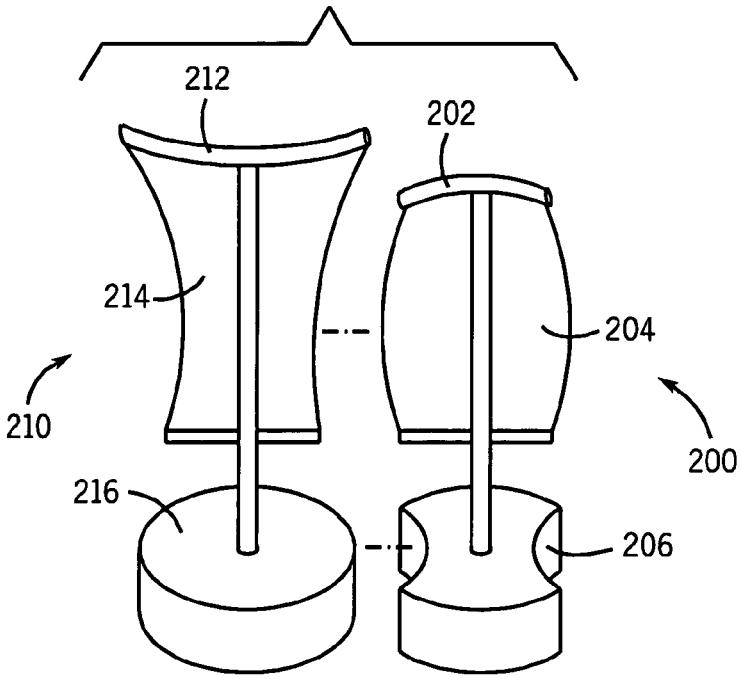

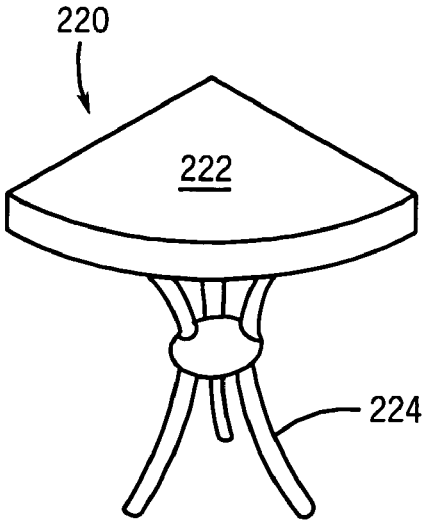
FIG. 16a
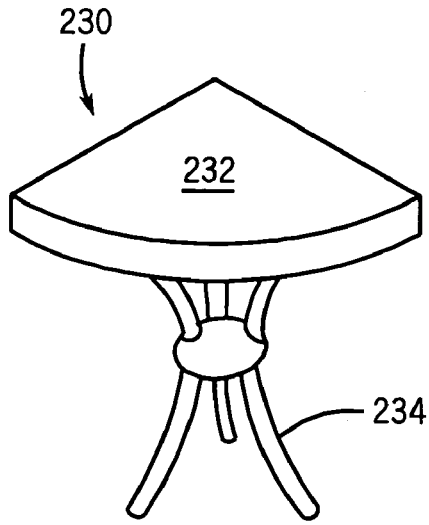
FIG. 16b
FIG. 17
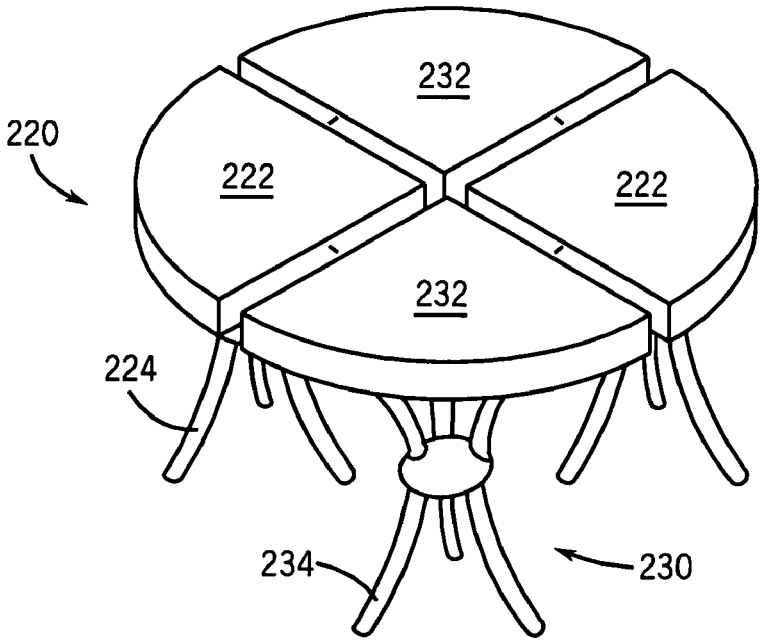

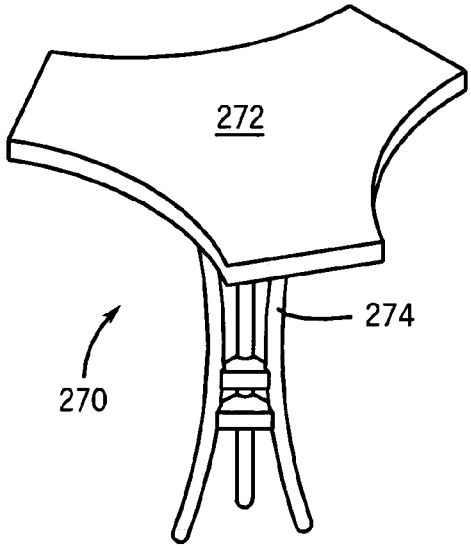
FIG. 20a
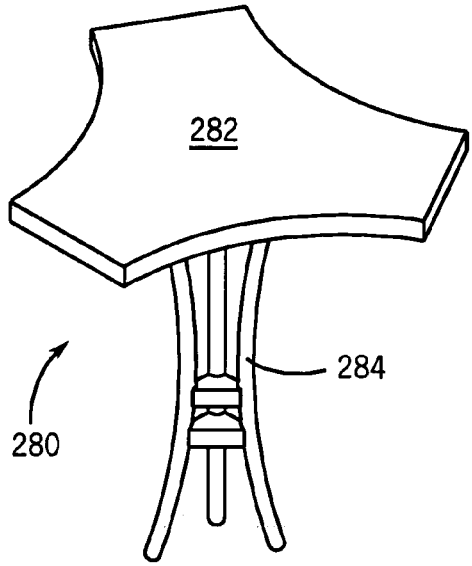
FIG. 20b
FIG. 21
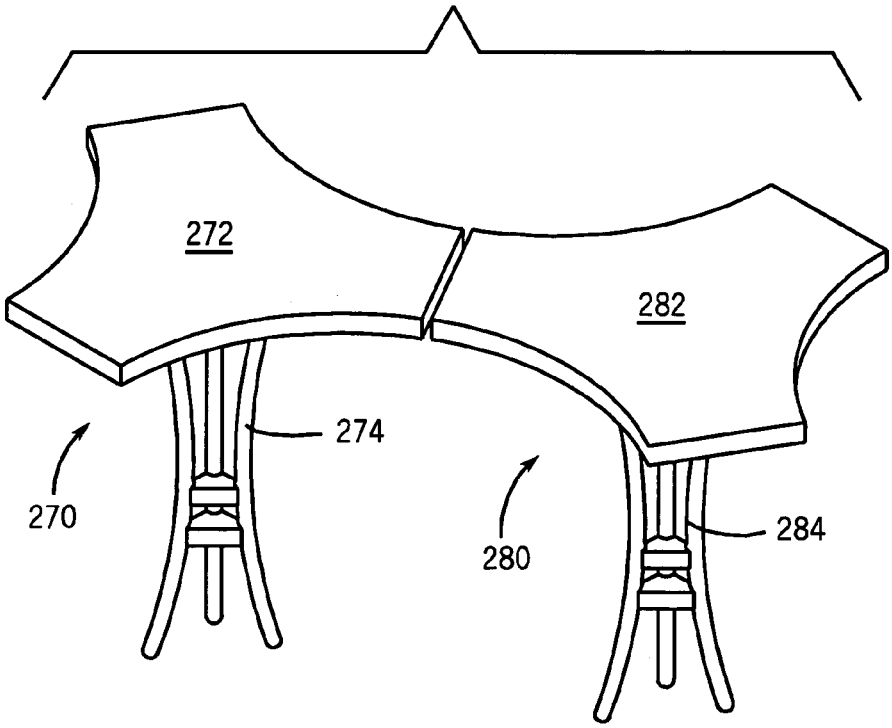

COMPOSITE ASSEMBLY OF INTERCONNECTABLE FURNITURE

CROSS REFERENCE TO RELATED U.S. PATENT APPLICATION(S)

The present patent application is related to U.S. patent application Ser. No. 11/059,095, now U.S. Pat. No. 7,237, 845, issued Jul. 3, 2007, entitled "Furniture Designed for Sitting and Having Inner Core Support Assembly". The present patent application is further related to U.S. patent application Ser. No. 11/059,162, now U.S. Pat. No. 7,131, 699, issued Nov. 7, 2006, entitled "Furniture with Seating Space and Entertainment Center".

FIELD OF THE INVENTION

The present invention relates in general to furniture and furnishings, more particularly, to a composite assembly of interconnectable furniture units.

BACKGROUND OF THE INVENTION

Furniture can be found in virtually every home, business, office, and many outdoor settings. Furniture performs a variety of useful functions such as providing seating places and surfaces for placing items thereon. Some furniture is designed and constructed for one person to use. For example, a single chair is intended to comfortably support the weight and form of one person. Other types of furniture are compatible with multiple users. A sofa or sectional will easily accommodate more than one person.

When the end user, e.g., homeowner or business owner, is planning for the purchase and placement of furniture in their particular environment, many factors are carefully considered such as function, usage, style, price, etc. Assume the end user is planning a backyard furniture arrangement for entertaining and relaxing. The user may decide on an outdoor dining table and set of 4-6 individual chairs around the table. In addition, the user may want a few chase lounges, recliners, and rockers with ottomans, as well as some coffee tables and end tables. Each piece of furniture has a specific dedicated purpose and generally cannot be interchanged for another function.

Consider the case of the outdoor dining table and chair set. The outdoor dining set is intended to stay together and provide a table surface for food and entertaining and chairs for seating around the table. To pull one or more chairs away from the outdoor dining set, for another long term and entirely different purpose, separate from the dining set, is considered undesirable and poor form to many users. Likewise, the idea of moving just the table to another location for an extended period of time is equally rejected by many users. Most outdoor furniture has a single functional purpose and usually stays with that purpose over its useful service life.

With the single mindset of maintaining dedicated pieces of furniture, the user must plan and purchase additional furniture units for each specific use and setting. The user may have some furniture pieces for the patio, other furniture pieces around the outdoor fire pit, still other furniture positioned around the pool, and so on. Some pieces are designed and constructed for one person to use; other pieces are built for multiple users. The single dedicated-purpose furniture adds significant cost to the task of furnishing the home, office, or outdoor setting. The user needs many different pieces to cover all intended uses. Many times certain dedicated pieces are rarely used, but nonetheless remain in their assigned location just in case the need arises.

A need exists for furniture which can have multiple uses in a variety of configurations and situations.

SUMMARY OF THE INVENTION

In one embodiment, the present invention is a plurality of furniture units, comprising a first furniture unit having an irregular surface. A second furniture unit has an irregular surface. The first and second furniture units each have a solo utilization. The first and second furniture units have a joint utilization when the irregular surface of the first furniture unit is disposed in proximity to the irregular surface of the second furniture unit.

In another embodiment, the present invention is an article of furniture, comprising first and furniture units each having a solo utilization. The first and second furniture units have a joint utilization which differentiates from the solo utilizations of the first and second furniture units when the first furniture unit is disposed in proximity to the second furniture unit.

In another embodiment, the present invention is a composite assembly of furniture units, comprising a first furniture unit having a solo utilization. A second furniture unit has a solo utilization. A means for combining the first and second furniture units provides a joint utilization of the first and second furniture units which differentiates from the solo utilizations of the first and second furniture units.

In another embodiment, the present invention is a method of making an article of furniture, comprising providing a first furniture unit having a solo utilization, providing a second furniture unit having a solo utilization, and providing a joint utilization of the first and second furniture units which differentiates from the solo utilizations of the first and second furniture units when the first furniture unit is disposed in proximity to the second furniture unit.

BRIEF DESCRIPTION OF THE DRAWINGS

FIGS. 1*a*-1*b* illustrate similar articles of furniture having an irregular shape;

FIG. 2 illustrates three units of the irregular-shaped furniture from FIG. 1 connected together to form a larger unit of furniture;

FIGS. 3*a*-3*e* illustrate mechanical coupling mechanisms for interconnecting the furniture units;

FIGS. 14*a*-14*b* illustrate first and second sunlight shading units;

FIG. 15 illustrates a two-piece composite assembly using the furniture units from FIGS. 14*a*-14*b*;

FIGS. 16*a*-16*b* illustrate first and second table tops and support bases;

FIG. 17 illustrates a four-piece composite assembly using the furniture units from FIGS. 16*a*-16*b*;

FIGS. 20*a*-20*b* illustrate another embodiment of first and second table tops and support bases;

FIG. 21 illustrates a two-piece composite assembly using the furniture units from FIGS. 20*a*-20*b*;

DETAILED DESCRIPTION OF THE DRAWINGS

Figure 4B:
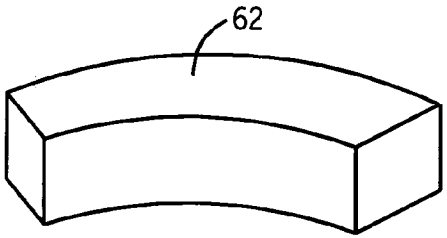
FIGS. 4*a*-4*b* illustrate two benches with interconnectable design.

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Referring to FIG. 1*a*, an article of furniture 10 is designed and constructed for sitting purposes and shown as suitable for supporting the weight and form of one or more adult persons. Furniture unit 10 is useful for many applications including home, office, industry, and outdoor spaces. Furniture unit 10 is durable, inexpensive, and may be used in settings such as office waiting rooms, employee break rooms, and family room in the home. Furniture unit 10 is ideal for outdoor uses such as on the patio, under the gazebo, and around the pool for relaxing and entertaining.

Furniture unit 10 has upper portion 12 designed to support the weight and form of one or more adults. Furniture unit 10 may have an inner core assembly with a foam or padded covering. The inner core assembly is disclosed herein. The upper portion 12 rests on frame or support base 14, which contacts the ground on at least the four corners of the unit. Furniture unit 10 may be 36 inches wide by 90 inches long by 20 inches in height. The long sides 16 and 18 of furniture unit 10 have an irregular shape. In the embodiment shown in FIG. 1*a*, the long sides 16 and 18 have a contoured, curved, or S-shape. The contoured shape, while visually interesting and appealing to observers, provides a useful function in the context of the present invention.

Turning to FIG. 1*b*, article of furniture 20 is designed and constructed for sitting purposes and shown as suitable for supporting the weight and form of one or more adult persons. Furniture unit 20 has upper portion 22 which may contain a similar inner core assembly with a foam or padded covering. The upper portion 22 rests on a frame or support base 24, which contact the ground on at least the four corners of the unit. Furniture unit 20 may be 36 inches wide by 90 inches long by 20 inches in height. The long sides 26 and 28 of furniture unit 20 have an irregular shape. In the embodiment shown in FIG. 1*b*, the long sides 26 and 28 have a contoured, curved, or S-shape. Again, the contoured shape, while visually interesting and appealing to some observers, provides a useful function in the context of the present invention.

Furniture units 10 and 20 can be used separate and independent of one another for their intended purpose. Each furniture unit is a stand-alone unit and has a solo utility or utilization. In the case of furniture units 10 and 20, the solo utilization is separate sitting and lounging. The user can position furniture unit 10 is a first location, e.g., on the patio, and then sit on upper portion 12, possibly with others, independent of the utilization of furniture unit 20. The user can position furniture unit 20 is a second location, e.g., by the pool, and then sit on upper portion 22, possibly with others, independent of the utilization of furniture unit 10.

As a feature of the present invention, the articles of furniture 10 and 20 are made modular and interconnectable so that they can be brought together to form a composite assembly having joint useful features, utilities, and capabilities. FIG. 2 illustrates furniture units 10 and 20 placed side by side. Frames 14 and 24 contact the ground to support the respective units. The long side 18 of furniture unit 10 is disposed adjacent to, in contact with, or in close proximity to, the long side 26 of furniture unit 20.

Another article of furniture 30, having a similar design and construction as furniture units 10 and 20 is placed side by side with furniture unit 20. Furniture unit 30 has upper portion 32 which may contain a similar inner core assembly with a foam or padded covering. The upper portion 32 rests on frame or support base 34, which contact the ground on at least the four corners of the unit. Furniture unit 30 may be 36 inches wide by 90 inches long by 20 inches in height. The long sides 36 and 38 of furniture unit 30 have an irregular shape. In the embodiment shown in FIG. 2, the long sides 36 and 38 have a contoured, curved, or S-shape. The long side 28 of furniture unit 20 is disposed adjacent to, in contact with, or in close proximity to, the long side 36 of furniture unit 30.

The composite assembly of furniture units 10, 20, and 30 placed side by side constitutes a unique and functionally different article of furniture than the individual furniture units 10, 20, and 30 alone. The joint utility or utilization of composite assembly 10-20 functionally differentiates from the solo utilization of individual furniture units 10, 20, and 30. The composite assembly 10-30 has a greater surface area and weight carrying capacity than the individual furniture units 10-30 alone. The composite assembly 10-30 is about 108 by 90 inches. The composite assembly 10-30 can be used by one or more persons to spread out, lay on, or sun bathe. The larger area of composite assembly is ideal as a sleeping surface, play area for children and infants, area to play games, and gathering place for teenagers, which is clean, safe, and off the ground. The above exemplary joint utilization of the composite assembly cannot practically or conveniently be achieved with the solo utilization of the individual furniture units 10, 20, and 30. The user may find many other purposes for the larger surface area provided by the joint utilization of the composite assembly 10-30.

In one embodiment, the furniture units 10-30 are brought together and maintain their close proximity by nature of the mass inertia of the units. The weight of the furniture units and coefficient of static friction of the support bases to the ground keep the units together as the composite assembly.

In another embodiment, the furniture units 10-30 can be mechanically coupled together for additional strength and rigidity of the composite assembly. FIGS. 3*a*-3*e* illustrate a few ways of mechanical coupling the furniture units together. In one example, the furniture units are coupled together with a latching or clamping mechanism. The latching mechanism can be located in any convenient location of the respective furniture units. In FIG. 3*a*, the frame 14 of furniture unit 10 is shown coupled to frame 24 of furniture unit 20 with latching mechanism 40. The latching mechanism may be on one end or both ends of each furniture unit to hold the composite assembly together. In FIG. 3*b*, magnetic plates 42 and 44 are mounted to frames 14 and 24 of furniture units 10 and 20, respectively. When frame 14 is brought in close proximity to frame 24, the attractive magnetic forces of magnetic plates 42 and 44 will secure the furniture units together as the composite assembly. In FIG. 3*c*, furniture unit 10 is provided with loops 46. Likewise, furniture unit 20 is given loops 48. The loops 46 and 48 may be made of fabric, plastic, or metal. A rod 50 is routed through loops 46 and 48 as shown to secure furniture units 10 and 20 as the composite assembly. In FIG. 3*d*, the furniture units 10 and 20 are held together with U-shaped brace or bracket 52. The U-shaped brace 52 is made of plastic or metal and slides into openings in upper portions 12 and 22 of furniture units 10 and 20. Alternatively, the U-shaped brace 52 may also slide into openings in frames 14 and 24. In FIG. 3*e*, Velcro strips 54 and 54 are mounted to upper portions 12 and 22 of furniture units 10 and 20, respectively. The Velcro strips may be mounted to one or more locations along the long side of the upper portions of the furniture units. When upper portion 12 is brought into contact with upper portion 14, the Velcro strips will stick together to secure the furniture units together as the composite assembly. The above techniques of mechanically coupling the furniture units together are provided by way of example; other securing mechanisms can also be used to hold the composite assembly together.

The irregular shape of furniture 10-30 enhances the mechanical coupling between the units. The irregular shape increases the contact surface area between the furniture units and improves the shear forces against unintentional movement. If any one of the furniture units is jarred or bumped, it is less likely that the composite assembly will dislodge from its unioned state.

One advantage of the form and function of furniture units 10-30 is the versatility to use the pieces both as individual articles of furniture and as components of the composite assembly. The user need not purchase and store multiple pieces of furniture. If the user has need of separate and solo utilization of seating benches or lounges, such as shown in FIGS. 1*a*-1*b*, then furniture units are left detached and used separately. If the user needs a larger composite assembly, such as shown in FIG. 2, then the furniture units 10-30 are placed in proximity to one another and optionally mechanically coupled together. The user then has the benefit of the joint utilization of the composite assembly 10-30. The furniture units 10-30 are efficient, cost effective, and versatile.

Figure 4A:
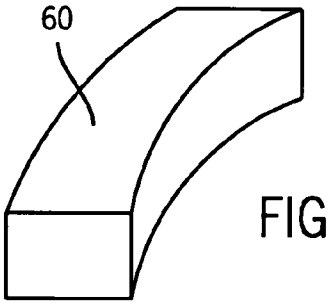

In FIG. 4*a*, an article of furniture 60 is shown suitable for sitting purposes and supporting the weight and form of one or more adult persons. An article of furniture 62 is shown in FIG. 4*b* suitable for sitting purposes and supporting the weight and form of one or more adult persons. Furniture units 60 and 62 each have an irregular curved shape and may be constructed with an inner core assembly with foam or padded exterior as described above.

Figure 5:
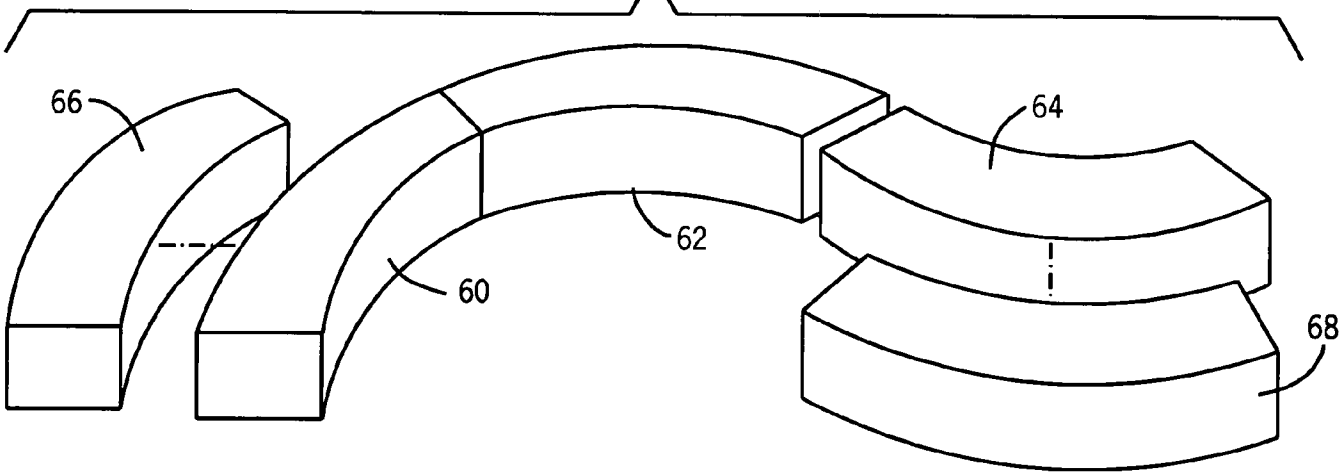
FIG. 5 illustrates five benches from FIG. 4*a*-4*b* as a composite assembly.

Furniture units 60 and 62 can be used separate and independent of one another for their intended purpose. Each article of furniture 60 and 62 is a stand-alone unit and has a solo utility or utilization, e.g., sitting and lounging. The furniture units 60 and 62 are made modular and interconnectable so that they can be brought together to form a composite assembly having jointly useful features, utilities, and capabilities by virtue of the combination of the individual furniture units. FIG. 5 illustrates furniture units 60 and 62 placed end to end. Another article of furniture 64, having a similar design and construction as furniture units 60 and 62, is placed end to end with furniture unit 62.

The composite assembly of furniture units 60, 62, and 64 placed end to end constitutes a unique and functionally different article of furniture having a greater surface area than the individual furniture units 60-64 alone. The composite assembly 60-64 provides a longer continuous bench area for additional seating. Additional furniture units 66 and 68 may be placed side by side with furniture units 60 and 64, respectively. The irregular surface of furniture unit 60 is placed in proximity to or in contact with the irregular surface of furniture unit 66. The irregular surface of furniture unit 64 is placed in proximity to or in contact with the irregular surface of furniture unit 68. The irregular surface area contact helps keep the composite assembly together. The composite assembly 60-68 provides a longer and, in areas, wider continuous bench area for additional seating. The curved nature of the composite assembly 60-68 provides more seating room in a given longitudinal distance and given area. The furniture units 60-68 can be mechanically coupled together for additional strength and rigidity of the composite assembly in a similar manner as described in FIGS. 3*a*-3*e*.

The form and function of furniture units 60-68 provides the versatility to use the pieces both as individual articles of furniture and as components of the composite assembly. If the user has need of separate and solo utilization of seating benches or lounges, such as shown in FIGS. 4*a*-4*b*, then furniture units are left detached and used separately. If the user needs a larger composite assembly, such as shown in FIG. 5, then the furniture units 60-68 are placed in proximity to one another and optionally mechanically coupled together. The user then has the benefit of the joint utilization of the composite assembly 60-68. The furniture units 60-68 are efficient, cost effective, and versatile.

Figure 6A:
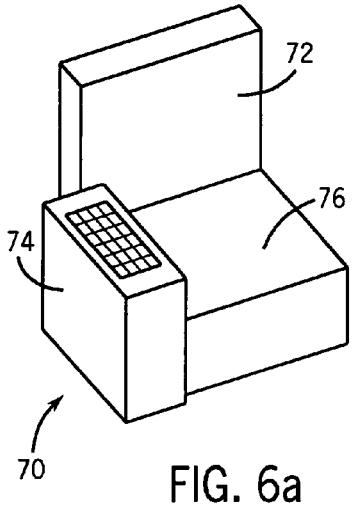
FIGS. 6*a*-6*b* illustrate two chairs with single armrest and interconnectable design.
Figure 6B:
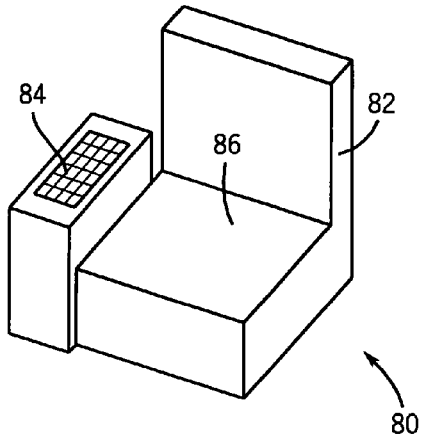

In FIG. 6*a*, an article of furniture 70 is shown suitable for sitting purposes and supporting the weight and form of an adult person. Furniture unit 70 has a back 72, armrest 74 on one side of the chair, and seating area 76. An article of furniture 80 is shown in FIG. 4*b* suitable for sitting purposes and supporting the weight of an adult person. Furniture unit 80 has a back 82, armrest 84 on one side of the chair, and seating area 86.

Figure 7:
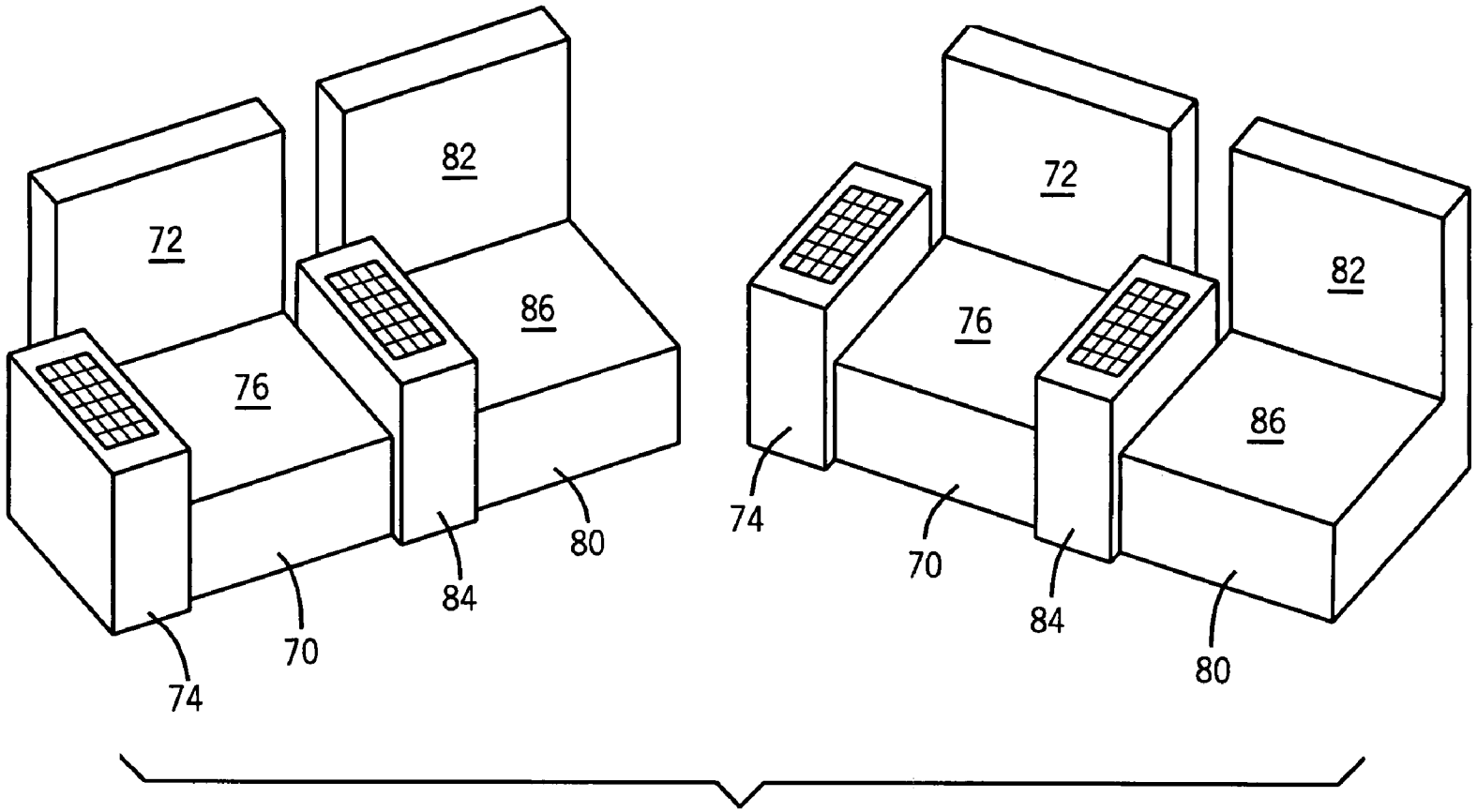
FIG. 7 illustrates two sets of two chairs from FIG. 6*a*-6*b* as a composite assembly.

Furniture units 70 and 80 can be used separate and independent of one another for their intended purpose. Each article of furniture 70 and 80 is a stand-alone unit and has a solo utility or utilization, e.g., sitting. The furniture units 70 and 80 are made modular and interconnectable so that they can be brought together to form a composite assembly having jointly useful features, utilities, and capabilities by virtue of the combination of the individual furniture units. FIG. 7 illustrates two sets of furniture units 70 and 80 placed side by side. One joint feature of the composite assembly 70-80 is that the armrest of each furniture unit is shared with the adjacent furniture unit.

The composite assembly of furniture units 70 and 80 placed side by side constitutes a unique and functionally different article of furniture than the individual furniture units 70 and 80 alone. The joint utility or utilization of composite assembly 70-80 functionally differentiates from the solo utilization of individual furniture units 70 and 80. The composite assembly 70-80 provides a close and compact seating arrangement and allows adjacent furniture units to share armrests. The furniture units 70-90 can be mechanically coupled together for additional strength and rigidity of the composite assembly.

Figure 8:
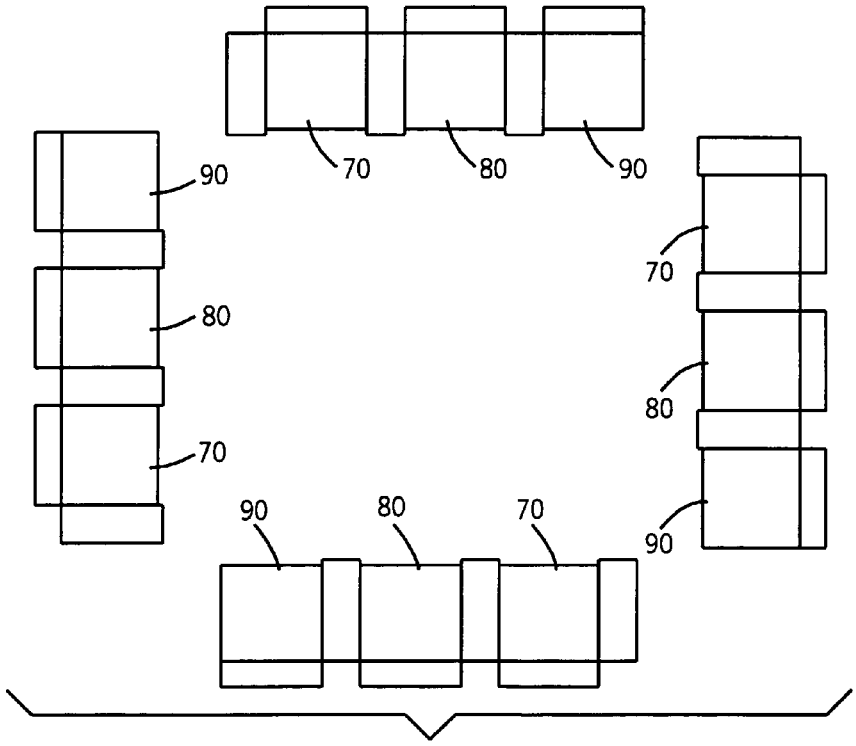
FIG. 8 illustrates four sets of three chairs from FIG. 6*a*-6*b* as a composite assembly.
Figure 9:
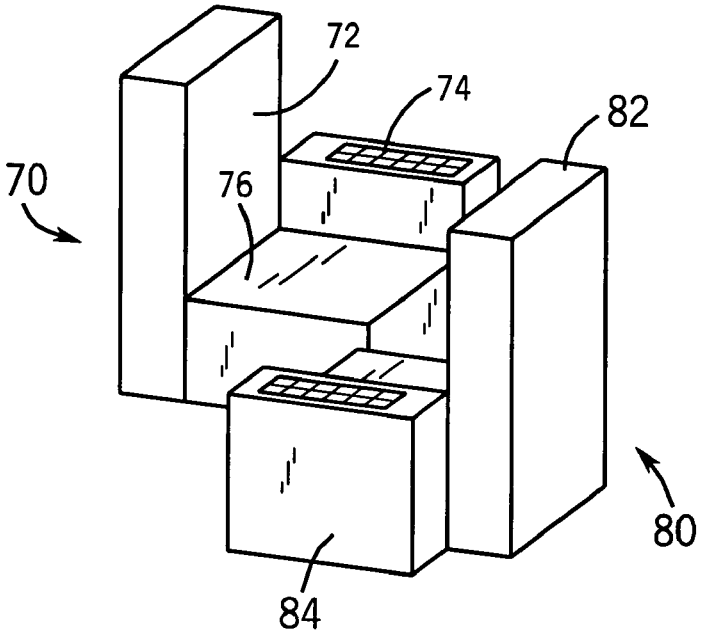
FIG. 9 illustrates two chairs from FIG. 6*a*-6*b* as a composite assembly.

FIG. 8 illustrates the modular and interconnectable furniture units 70, 80, and 90 arranged three abreast in four separate groupings facing a center area. The center area may contain a coffee table or fire pit. The composite assembly 70-90 illustrates the convenience of combining what are otherwise separate and independent furniture units into a compact grouping which share common features. FIG. 9 illustrates the furniture units 70 and 80 facing one another for private conversations.

Figure 10:
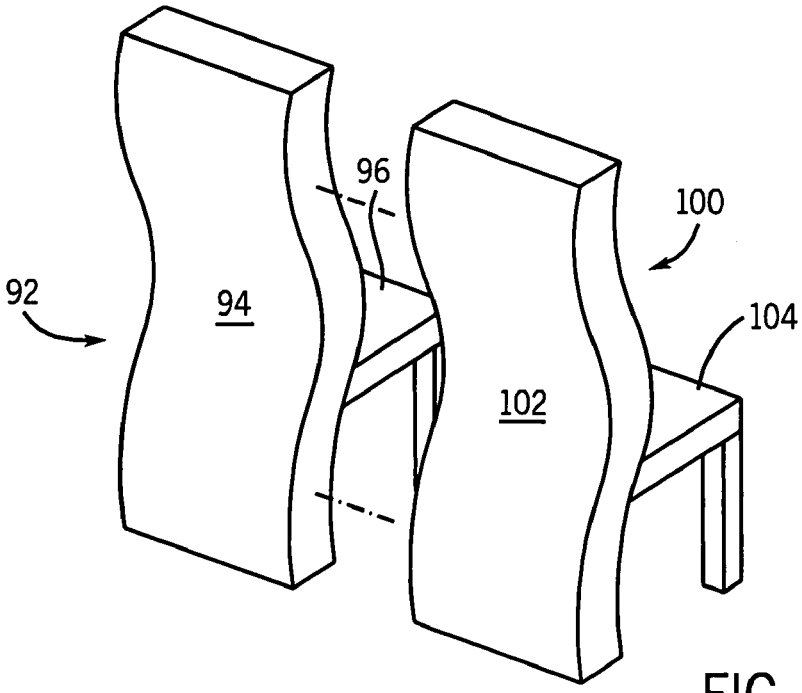
FIG. 10 illustrates two chairs as a composite assembly.

FIG. 10 illustrates an article of furniture 92 which is suitable for sitting purposes and supporting the weight and form of an adult person. Furniture unit 92 has a back 94 and seating area 96. An article of furniture 100 is also suitable for sitting purposes and supporting the weight and form of an adult person. Furniture unit 100 has a back 102 and seating area 104. The backs 94 and 102 have an irregular shape. In the embodiment shown in FIG. 10, the back 94 and 102 have a contoured, curved, or S-shape.

Furniture units 92 and 100 can be used separate and independent of one another for their intended purpose. Each article of furniture 92 and 100 is a stand-alone unit and has a solo utility or utilization, e.g., sitting. The furniture units 92 and 100 are made modular and interconnectable so that they can be brought together to form a composite assembly having jointly useful features, utilities, and capabilities by virtue of the combination of the individual furniture units. The composite assembly of furniture units 92 and 100 placed side by side constitutes a unique and functionally different article of furniture than the individual furniture units alone. The composite assembly 92-100 provides a close and compact seating arrangement. The contact point between the irregular surfaces of furniture units 92 and 100 helps hold the composite assembly together. The furniture units 92-100 can be mechanically coupled together for additional strength and rigidity of the composite assembly.

Figure 11:
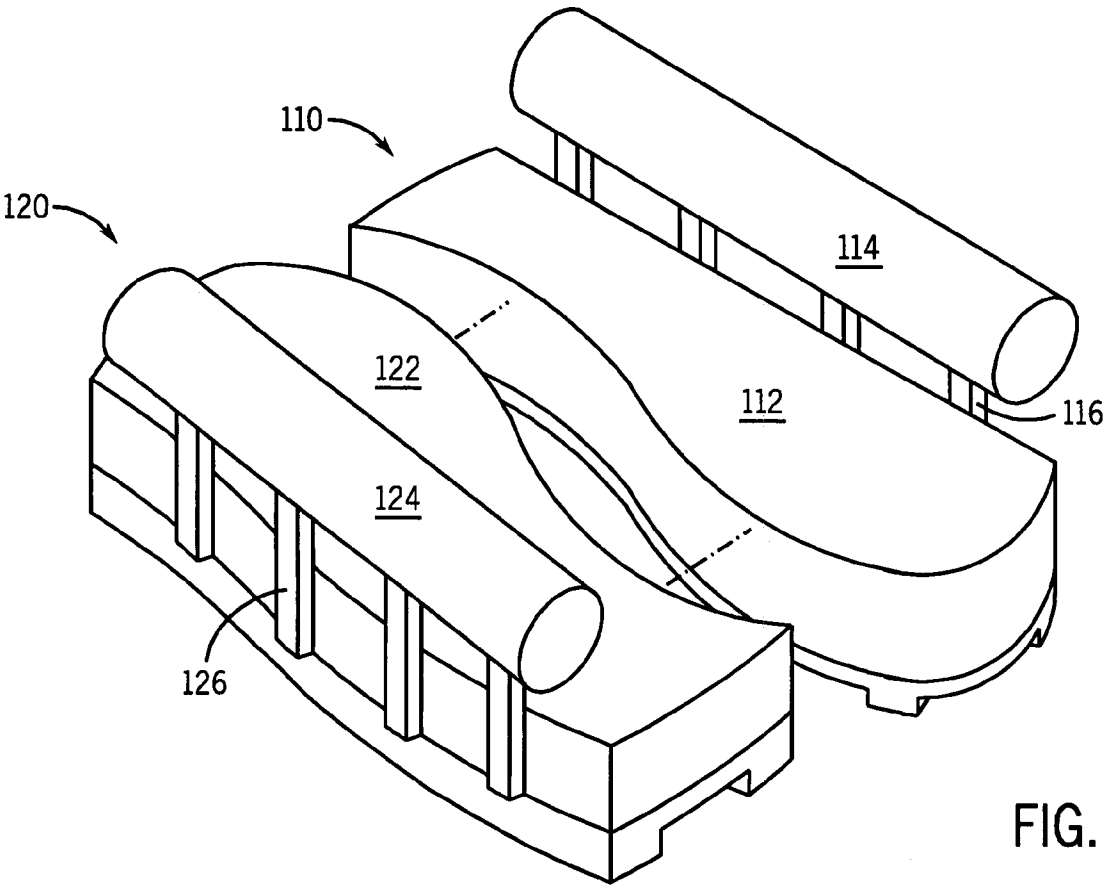
FIG. 11 illustrates two benches with backrests and interconnectable design.

FIG. 11 illustrates an article of furniture unit 110 which is suitable for sitting purposes and supporting the weight and form of one or more adult persons. Furniture unit 110 has a seating area 112 and backrest 114 connected to seating area 112 with back support bars 116. An article of furniture 120 is also suitable for sitting purposes and supporting the weight and form of one or more adult persons. Furniture unit 120 has a seating area 122 and backrest 124 connected to seating area 122 with back support bars 126. The seating areas 112 and 124 have an irregular shape. In the embodiment shown in FIG. 11, the seating areas 112 and 124 have a contoured, curved, or S-shape.

Furniture units 110 and 120 can be used separate and independent of one another for their intended purpose. Each article of furniture 110 and 120 is a stand-alone unit and has a solo utility or utilization, e.g., sitting and lounging. The furniture units 110 and 120 are made modular and interconnectable so that they can be brought together to form a composite assembly having jointly useful features, utilities, and capabilities by virtue of the combination of the individual furniture units. The composite assembly of furniture units 110 and 120 placed side by side constitutes a unique and functionally different article of furniture than the individual furniture units alone. The composite assembly 110-120 provides a larger seating area. The composite assembly 110-120 can be used by one or more persons to spread out, lay on, or sun bathe. The larger area of composite assembly is ideal as a sleeping surface, play area for children and infants, area to play games, and gathering place for teenagers, which is clean, safe, and off the ground. The furniture units 110-120 can be mechanically coupled together for additional strength and rigidity of the composite assembly in a similar manner as described in FIGS. 3*a*-3*e*.

Figure 12:
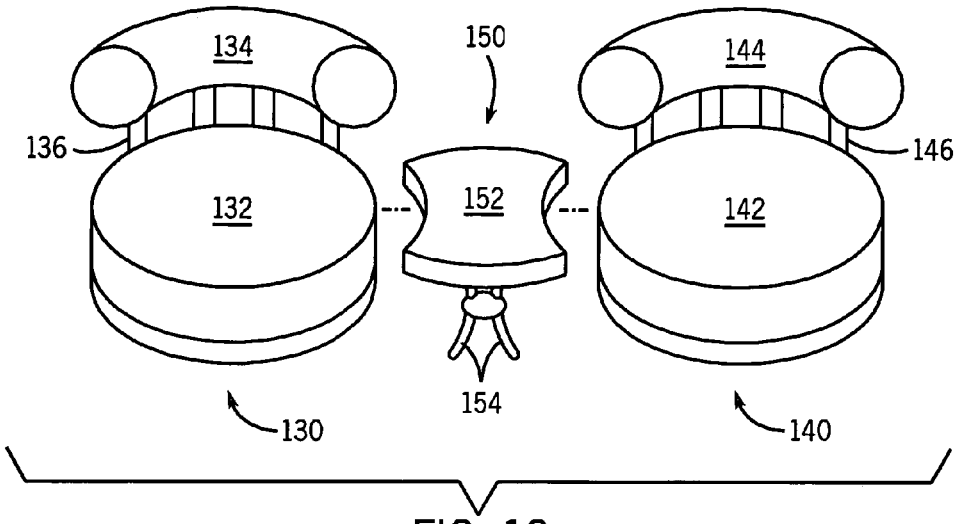
FIG. 12 illustrates two chairs and center table as a composite assembly.

FIG. 12 illustrates an article of furniture 130 which is suitable for sitting purposes and supporting the weight and form of an adult person. Furniture unit 130 has a seating area 132 and backrest 134 connected to seating area 132 with back support bars 136. An article of furniture 140 is also suitable for sitting purposes and supporting the weight and form of an adult person. Furniture unit 140 has a seating area 142 and backrest 144 connected to seating area 142 with back support bars 146. Seating areas 132 and 142 are circular or oval in shape. An article of furniture 150 is suitable for a table with top portion 152 and support base or legs 154. The table top portion 152 has an irregular convex form, which matches with the circular or oval shape of seating areas 132 and 142.

Furniture units 130-150 can be used separate and independent of one another for their intended purpose. Each article of furniture 130-150 is a stand-alone unit and has a solo utility or utilization, e.g., sitting or table top surface area. The furniture units 130-150 are made modular and interconnectable so that they can be brought together to form a composite assembly having jointly useful features, utilities, and capabilities by virtue of the combination of the individual furniture units. The composite assembly of furniture units 130-150 placed side by side constitutes a unique and functionally different article of furniture than the individual furniture units alone. The composite assembly 130-150 provides a dual chair with common table combination. The furniture units 130-150 can be mechanically coupled together for additional strength and rigidity of the composite assembly.

Figure 13:
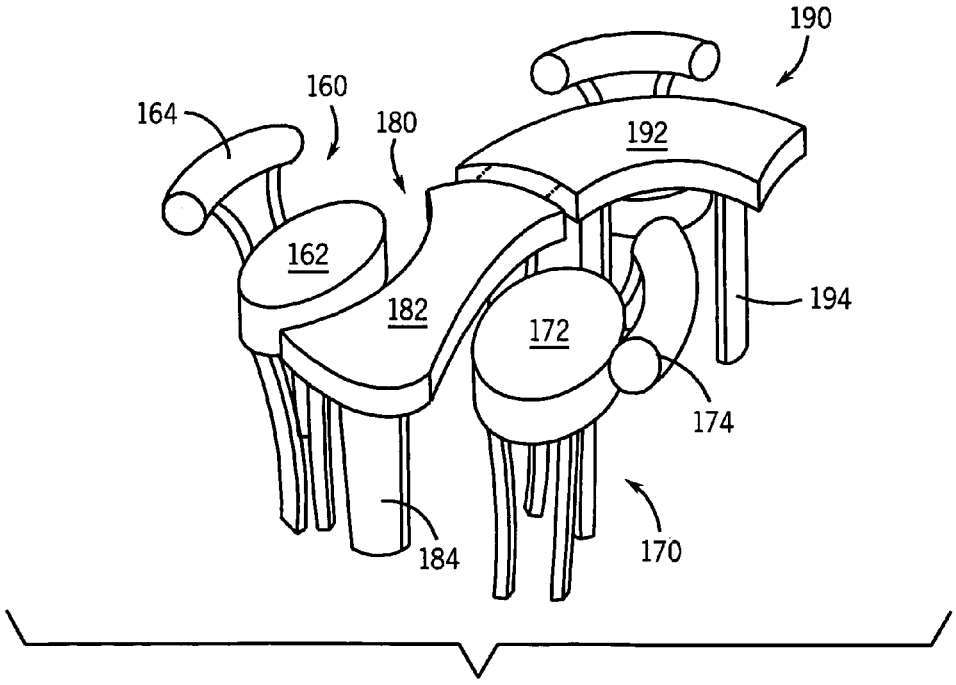
FIG. 13 illustrates three chairs and two tables as a composite assembly.

FIG. 13 illustrates an article of furniture 160 which is suitable for sitting purposes and supporting the weight and form of an adult person. Furniture unit 160 has a seating area 162 and backrest 164. An article of furniture 170 is also suitable for sitting purposes and supporting the weight and form of an adult person. Furniture unit 170 has a seating area 172 and backrest 174. Seating areas 162 and 172 are circular or oval in shape. An article of furniture 180 is suitable for a table with top portion 182 and support base or legs 184. An article of furniture 190 is suitable for a table with top portion 192 and support base or legs 194. The table top portion 182 and 192 have an irregular shape.

Furniture units 180 and 190 can be used separate and independent of one another for their intended purpose. Each article of furniture 180 and 190 is a stand-alone unit and has a solo utility or utilization, e.g., table top surface area. The furniture units 180 and 190 are made modular and interconnectable so that they can be brought together to form a composite assembly having jointly useful features, utilities, and capabilities by virtue of the combination of the individual furniture units. The composite assembly of furniture units 180-190 placed side by side constitutes a unique and functionally different article of furniture than the individual furniture units alone. The composite assembly 180-190 provides a longer table top surface. The composite assembly 180-190 gives the user more room for entertaining. The furniture units 180-190 can be mechanically coupled together for additional strength and rigidity of the composite assembly.

FIG. 14*a* illustrates an article of furniture 200 which is suitable for providing shade from sunlight. Furniture unit 200 has a vertical and horizontal frame 202, shading area 204, and base unit 206. An article of furniture 210 is shown in FIG. 14*b* also suitable for providing shade from sunlight. Furniture unit 210 has a vertical and horizontal frame 212, shading area 214, and base unit 216. The base units 206 and 216 have an irregular shape.

Furniture units 200-210 can be used separate and independent of each other for the intended purpose, e.g., shading the user from direct sunlight. Each article of furniture 200-210 is a stand-alone unit. The furniture units 200 and 210 are made modular and interconnectable so that they can be brought together to form a composite assembly having jointly useful features, utilities, and capabilities by virtue of the combination of the individual furniture units. The composite assembly of furniture units 200-210 placed side by side in FIG. 15 constitutes a unique and functionally different article of furniture than the individual furniture units alone. The composite assembly 200-210 provides a wider area of shade for the user. The furniture units 200-210 can be mechanically coupled together for additional strength and rigidity of the composite assembly.

FIG. 16*a* illustrates an article of furniture 220 which is suitable for providing a table surface. Furniture unit 220 has a table surface 222 and support base or legs 224. An article of furniture 230 is shown in FIG. 16*b* also suitable for providing a table surface. Furniture unit 230 has a table surface 232 and support base or legs 234. The table surfaces 222 and 232 have an irregular shape.

Furniture units 220-230 can be used separate and independent of each other for the intended purpose, e.g., providing a table surface. Each article of furniture 220-230 is a stand-alone unit. The furniture units 220 and 230 are made modular and interconnectable so that they can be brought together to form a composite assembly having jointly useful features, utilities, and capabilities by virtue of the combination of the individual furniture units. The composite assembly of four furniture units like 220-230 placed side by side in FIG. 17 constitutes a unique and functionally different article of furniture than the individual furniture units alone. The composite assembly 220-230 provides a large table surface area for the user. The furniture units 220-230 can be mechanically coupled together for additional strength and rigidity of the composite assembly.

Figure 18A:
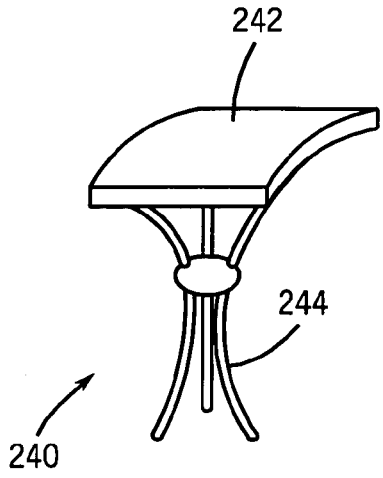
FIGS. 18*a*-18*b* illustrate another embodiment of first and second table tops and support bases.
Figure 18B:
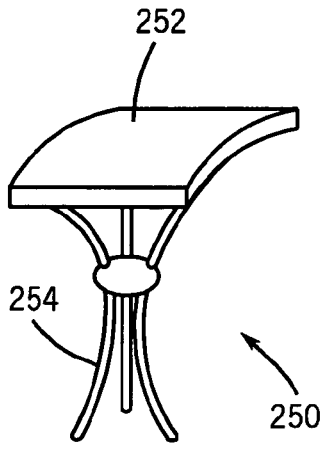
Figure 19:
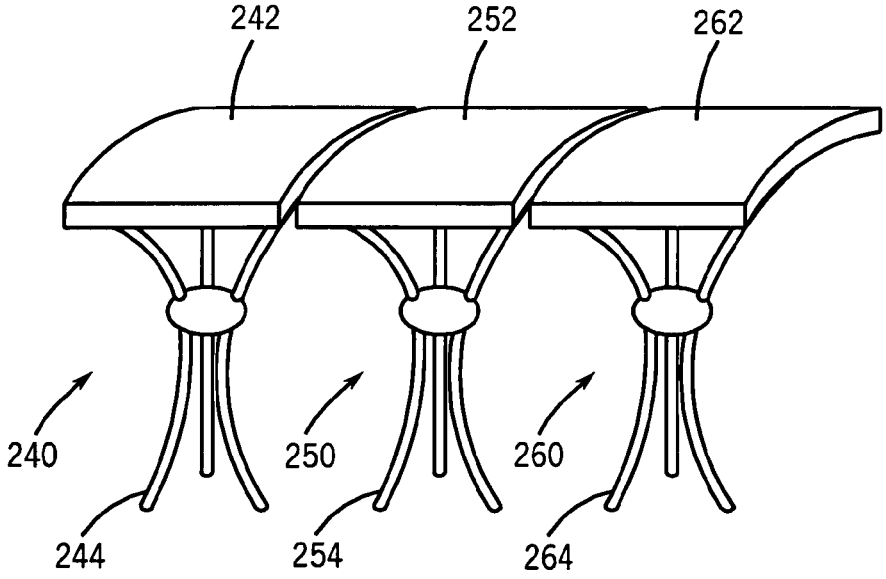
FIG. 19 illustrates a three-piece composite assembly using the furniture units from FIGS. 18*a*-18*b*.

FIG. 18*a* illustrates an article of furniture 240 which is suitable for providing a table surface. Furniture unit 240 has a table surface 242 and support base or legs 244. An article of furniture 250 is shown in FIG. 18*b* also suitable for providing a table surface. Furniture unit 250 has a table surface 252 and support base or legs 254. The table surfaces 242 and 252 have an irregular shape. Furniture unit 260 shown in FIG. 19 has a table surface 262 and support base or legs 264 and is added for more table surface area.

Furniture units 240-260 can be used separate and independent of each other for the intended purpose, e.g., providing a table surface. Each article of furniture 240-260 is a stand-alone unit. The furniture units 240-260 are made modular and interconnectable so that they can be brought together to form a composite assembly having jointly useful features, utilities, and capabilities by virtue of the combination of the individual furniture units. The composite assembly of four furniture units like 240-260 placed side by side in FIG. 19 constitutes a unique and functionally different article of furniture than the individual furniture units alone. The composite assembly 240-260 provides a large table surface area for the user. The furniture units 240-260 can be mechanically coupled together for additional strength and rigidity of the composite assembly.

FIG. 20*a* illustrates an article of furniture 270 which is suitable for providing a table surface. Furniture unit 270 has a table surface 272 and support base or legs 274. An article of furniture 280 is shown in FIG. 20*b* also suitable for providing a table surface. Furniture unit 280 has a table surface 282 and support base or legs 284. The table surfaces 272 and 282 have an irregular shape.

Figure 22:
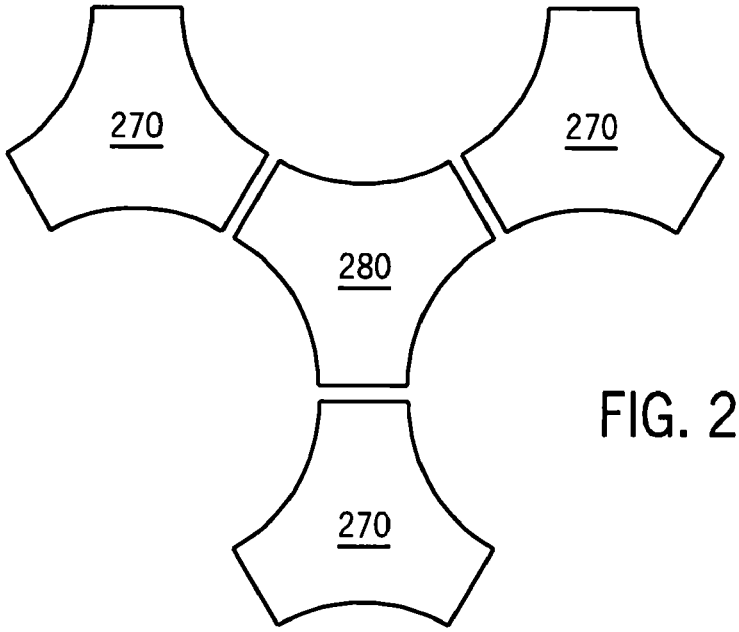
FIG. 22 illustrates a four-piece composite assembly using the furniture units from FIGS. 20*a*-20*b*.

Furniture units 270-280 can be used separate and independent of each other for the intended purpose, e.g., providing a table surface. Each article of furniture 270-280 is a stand-alone unit. The furniture units 270-290 are made modular and interconnectable so that they can be brought together to form a composite assembly having jointly useful features, utilities, and capabilities by virtue of the combination of the individual furniture units. The composite assembly of four furniture units like 270-280 placed side by side in FIG. 21 constitutes a unique and functionally different article of furniture than the individual furniture units alone. The composite assembly 270-280 provides a large table surface area for the user. FIG. 22 shows a composite assembly with four furniture units like 270-280. The furniture units 270-280 can be mechanically coupled together for additional strength and rigidity of the composite assembly.

Figure 23:
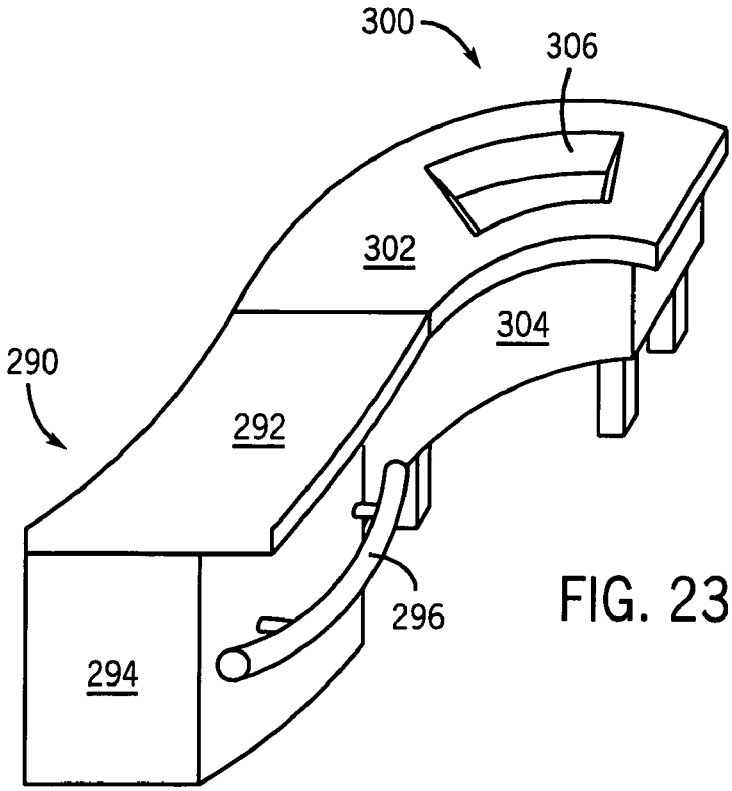
FIG. 23 illustrates another embodiment of first and second table tops and support bases.

FIG. 23 illustrates an article of furniture 290 which is suitable for providing a table surface. Furniture unit 290 has a table surface 292, support base 294, and foot rail 296. An article of furniture 300 is shown also suitable for providing a table surface. Furniture unit 300 has a table surface 302, support base 304, and sink or basin 306. The table surfaces 292 and 302 have an irregular shape.

Furniture units 290-300 can be used separate and independent of each other for the intended purpose, e.g., providing a table surface. Each article of furniture 290-300 is a stand-alone unit. The furniture units 290-300 are made modular and interconnectable so that they can be brought together to form a composite assembly having jointly useful features, utilities, and capabilities by virtue of the combination of the individual furniture units. The composite assembly of furniture units 290-300 placed end to end constitutes a unique and functionally different article of furniture than the individual furniture units alone. The composite assembly 290-300 provides a large table surface area for the user. The furniture units 290-300 can be mechanically coupled together for additional strength and rigidity of the composite assembly.

Figure 24:
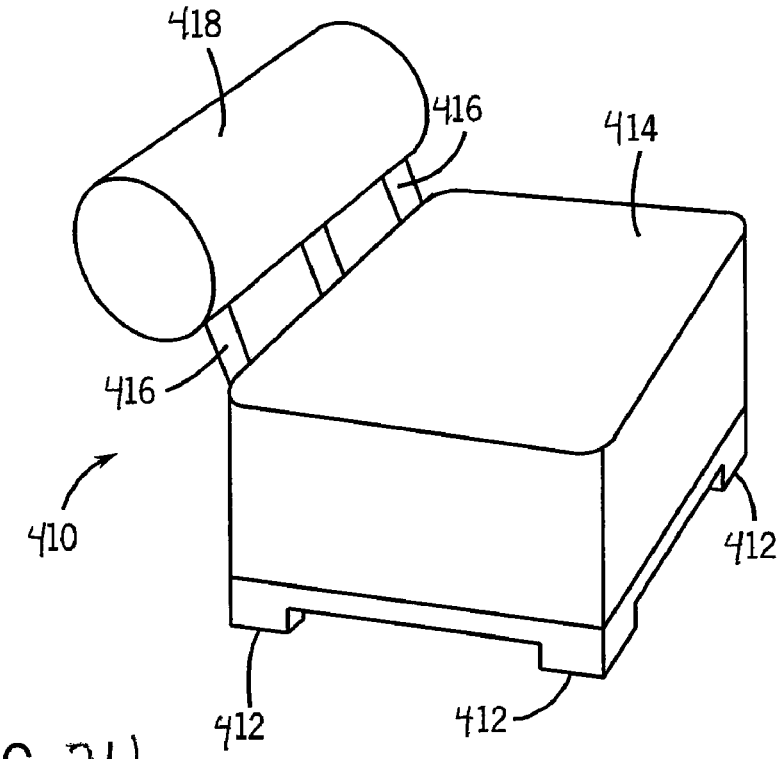
FIG. 24 illustrates an article of furniture with a back support designed for sitting.

Referring to FIG. 24, an article of furniture 410 is designed for sitting purposes and shown as suitable for supporting the weight of one or more adult persons. Furniture 410 is useful for many applications including home, office, industry, and outdoor spaces. Furniture 410 is durable, inexpensive, and may be used in settings such as office waiting rooms, employee break rooms, and family room in the home. Furniture 410 is ideal for outdoor uses such as on the patio, under the gazebo, and around the pool for relaxing and entertaining.

Sitting furniture 410 has legs 412 which are an integral component of a sitting portion inner core assembly (not shown in FIG. 24) as described more fully below. Sitting portion 414 is generally rectangular in shape, although circular, oval, and other regular and irregular shapes may be utilized. Sitting portion 414 includes cloth pads or cushions laid along and over the sides and top of the inner core assembly. In one embodiment, sitting portion 414 is 36 by 36 inches. A durable exterior fabric encloses at least the side and top pads and inner core assembly. The exterior fabric material is water proof, washable, and resistant to sun exposure and other outside elements.

As shown in FIG. 24, furniture 410 has back support bars 416 extending from the sitting portion inner core assembly to back support portion 418. The back support bars 416 are angled to provide lumbar support. The back support portion 418 also has a back support inner core assembly (not shown in FIG. 24) as described below. A cloth pad or cushion surrounds the back support inner core assembly. The back support portion 418 is cylindrical in shape, although it may be rectangular or take other forms and shapes.

Figure 25:
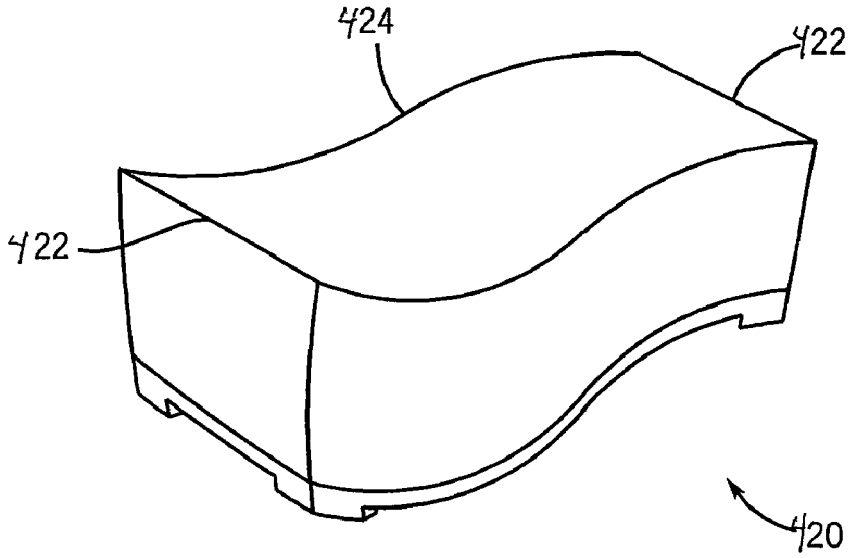
FIG. 25 illustrates an irregular shaped bench or multi-person seat.

Another embodiment of the sitting furniture is shown in FIG. 25. Sitting furniture 420 is shown as a bench or lounge and can provide seating space for multiple persons. In one embodiment, furniture 420 is 36 by 90 inches. Furniture 420 may include one or more back support portions (not shown) similar to FIG. 24 placed along one or both ends 422 or lengthwise side 424. The back support portion allows the user to recline or lounge on furniture 420. Furniture 420 has an irregular or contoured lengthwise side 424. Furniture 420 has a similar sitting portion inner core assembly and cloth pads or cushions laid along and over the sides and top of the sitting portion inner core assembly. A similar durable fabric encloses at least the side and top pads and inner core assembly of furniture 420.

Figure 26:
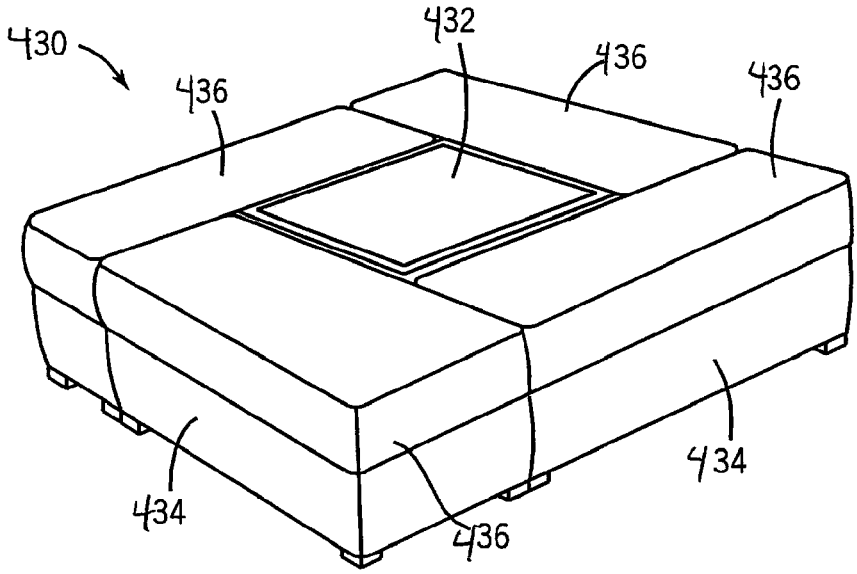
FIG. 26 illustrates a sectional lounge with decorative center feature.

Yet another embodiment of the sitting furniture is shown in FIG. 26. Sitting furniture 430 is shown as a sectional surrounding decorative center feature 432. The seating area provides ample space for multiple persons. Decorative center feature 432 can be a table or box for holding or containing items such as plants, artwork, pictures, decorations, fountain, fire pit, rock garden, food and beverages, entertainment center, and the like.

Furniture 430 uses four lower assemblies 434 and four upper assemblies 436 surrounding decorative center feature 432. Each lower assembly 434 has a sitting portion inner core support assembly. One or more thin cloth pads are disposed along and over the sides and top of each lower assembly 434. The lower assembly 434 is then covered with a fabric material. There are four upper assemblies 436, each having an interior cushion which is covered with a fabric exterior. The upper cushion assemblies 436 are placed on the lower assemblies 434 and may be held in place with Velcro. In one embodiment, the upper cushion assemblies 436 are offset over adjacent lower assemblies 434. The upper cushion assemblies 436 are easily removable for cleaning and maintenance. Furniture 430 may include one or more back support portions (not shown) similar to FIG. 24.

Figure 27:
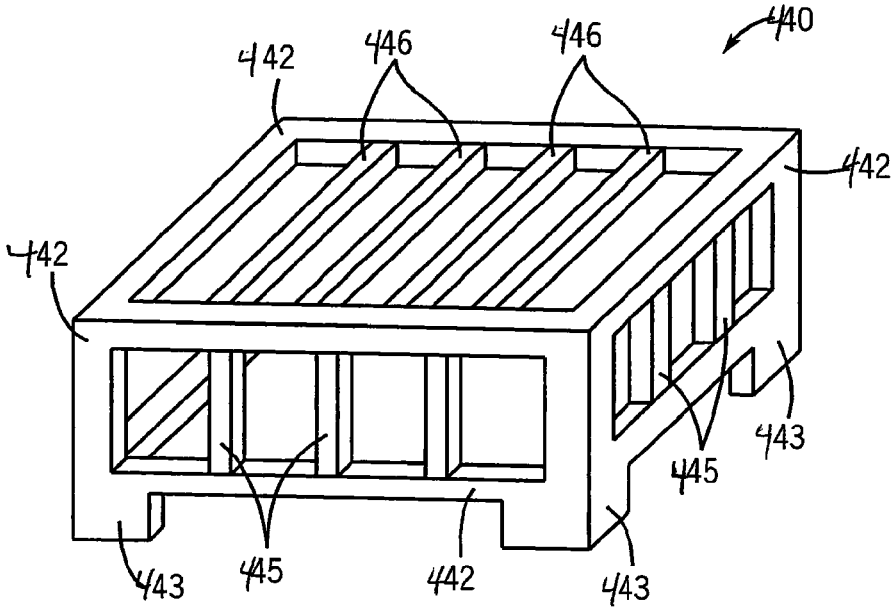
FIG. 27 is the inner core support assembly for the sitting furniture with horizontal bars.

One embodiment of the sitting portion inner core support assembly is shown in FIG. 27. The inner core assembly 440, or variation thereof as described below, may be used in sitting furniture 410, 420, and 430. The inner core assembly 440 has a box frame structure 442 made with interconnected bars as shown. Frame structure 442 has integral legs or base supports 443 designed to provide sturdy contact with the ground. A plurality of vertical bars 445 connects between upper and lower bar components of box frame 442 on each side of inner core assembly 440. A plurality of horizontal bars 446 connects opposite sides of the upper portion of box frame 442. The horizontal bars 446 may run either direction, diagonally, or crisscross the upper portion of box frame 442.

In one aspect, the horizontal bars 446 provide a structural weight-bearing support across the horizontal upper portion of the inner core assembly 440. However, it is the combination of box frame 442 with vertical bars 445 and horizontal bars 446 that provide the composite structural weight-bearing support of the inner core assembly 440. The inner core assembly 440 can be made of metal, wood, polymer, or other weight-bearing material. The inner core assembly 440 is sufficiently rigid and sturdy to support the weight of one or more adult persons without noticeable bending or deformation. The structure of the inner core assembly 440 maintains its shape and rigidity beyond the useful service life of the sitting furniture.

Figure 28:
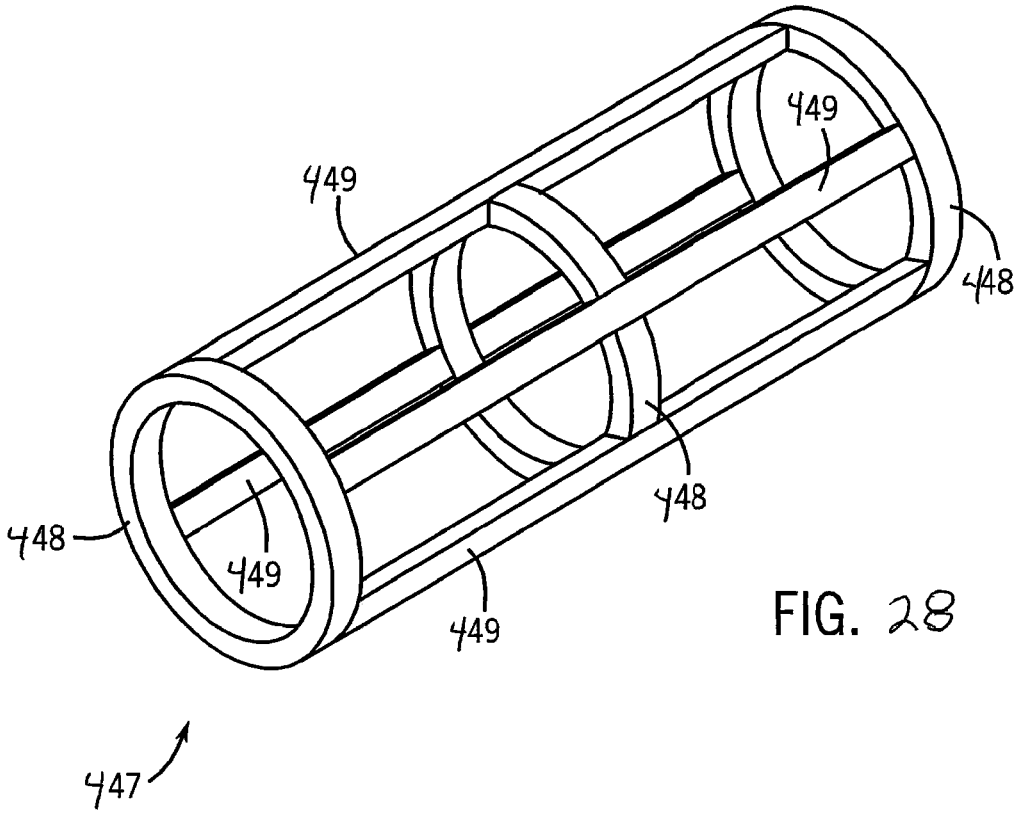
FIG. 28 is the inner core support assembly for the back support portion of the sitting furniture.

FIG. 28 illustrates the back support inner core assembly 447 forming the interior assembly of back support portion 418. The inner core assembly 447 is shown as being cylindrical in shape with circular end and center components 448 and connecting bars 449. The inner core assembly 447 can be made of metal, wood, polymer, or other weight-bearing material. Back support bars 416 connect between box frame 442 and inner core assembly 447. The structure of the inner core assembly 447 maintains its shape and rigidity beyond the useful service life of the sitting furniture.

Figure 29:
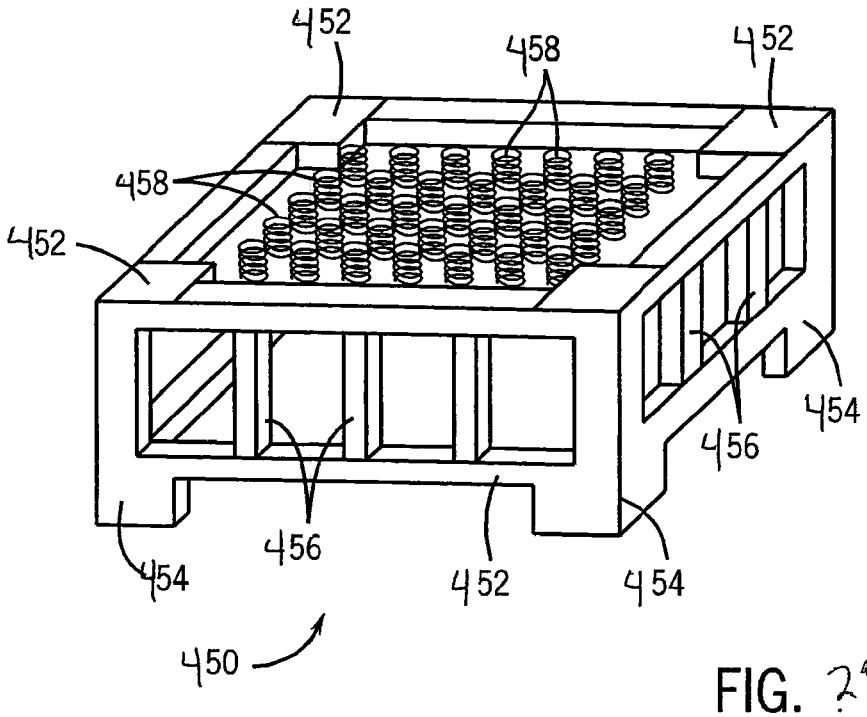
FIG. 29 is another embodiment of the inner core support assembly with supporting box springs.

Another embodiment of the sitting portion inner core assembly is shown in FIG. 29. The inner core assembly 450 has a box frame 452 with integral legs or base supports 454 similar to inner core assembly 440. A plurality of vertical bars 456 connects between upper and lower bar components of box frame 452 on each side of inner core assembly 450. A plurality of interconnected box springs 458 connects to the upper and lower portions of box frame 452.

The box springs 458 provide weight-bearing support for the horizontal upper portion of the inner core assembly 450. The combination of box frame 452, vertical bars 456, and springs 458 provide the composite structural weight-bearing support of the inner core assembly 450. As described for inner core assembly 440, back support bars 416 connect between box frame 452 and inner core assembly 447. The inner core assembly 450 can be made of metal, wood, polymer, or other weight-bearing material. The inner core assembly 450 is rigid to support the weight of one or more adult persons without noticeable bending or deformation. The structure of the inner core assembly 450 maintains its shape and rigidity beyond the useful service life of the sitting furniture.

Figure 30:
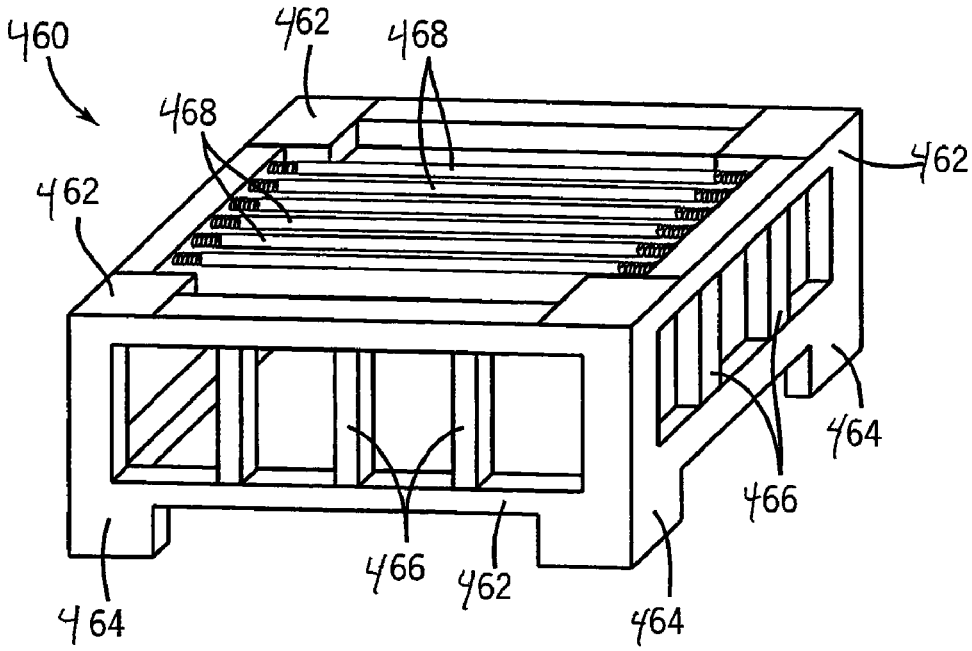
FIG. 30 is another embodiment of the inner core support assembly having free-floating bars with connecting springs attached to the inner core assembly.

Another embodiment of the inner core assembly is shown in FIG. 30. The inner core assembly 460 has a box frame 462 with integral legs or base supports 464 similar to inner core assembly 440. A plurality of vertical bars 466 connects between upper and lower bar components of box frame 462 on each side of the inner core assembly 460. A plurality of free-floating horizontal bars with connecting springs 468 mounts to the upper bar components of box frame 462.

The free-floating bars with connecting springs 468 provide the weight-bearing support for the horizontal upper portion of the inner core assembly 460. The combination of box frame 462, vertical bars 466, and free-floating horizontal bars with connecting springs 468 provides the structural weight-bearing support of the inner core assembly 460. As described for inner core assembly 440, back support bars 416 connect between box frame 462 and inner core assembly 447. The inner core assembly 460 can be made of metal, wood, polymer, or other weight-bearing material. The inner core assembly 460 is rigid to support the weight of one or more adult persons without noticeable bending or deformation. The structure of the inner core assembly 460 maintains its shape and rigidity beyond the useful service life of the sitting furniture.

Figure 31:
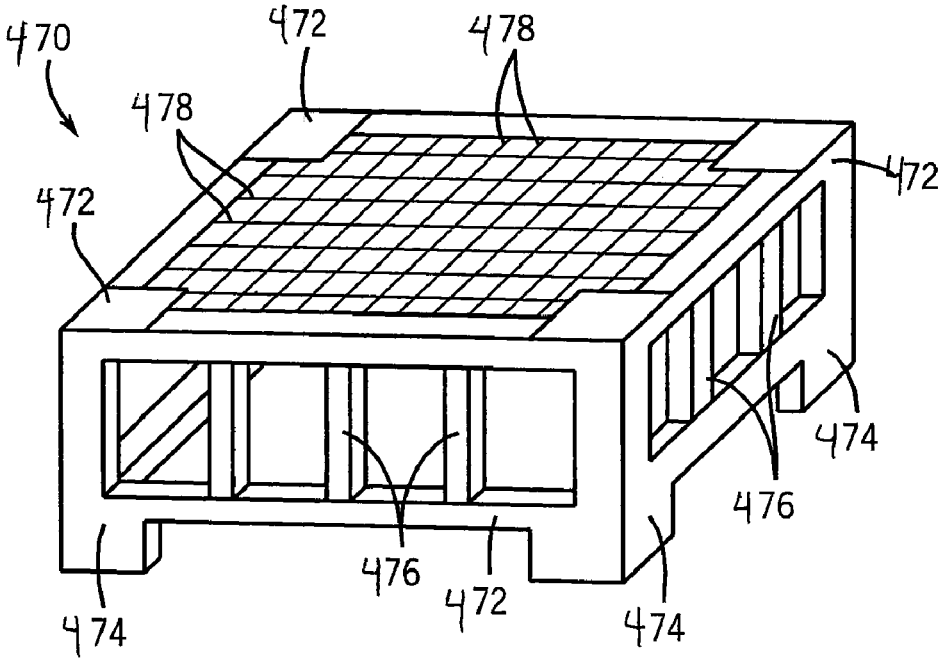
FIG. 31 is another embodiment of the inner core support assembly with supporting mesh pattern.
Figure 32:
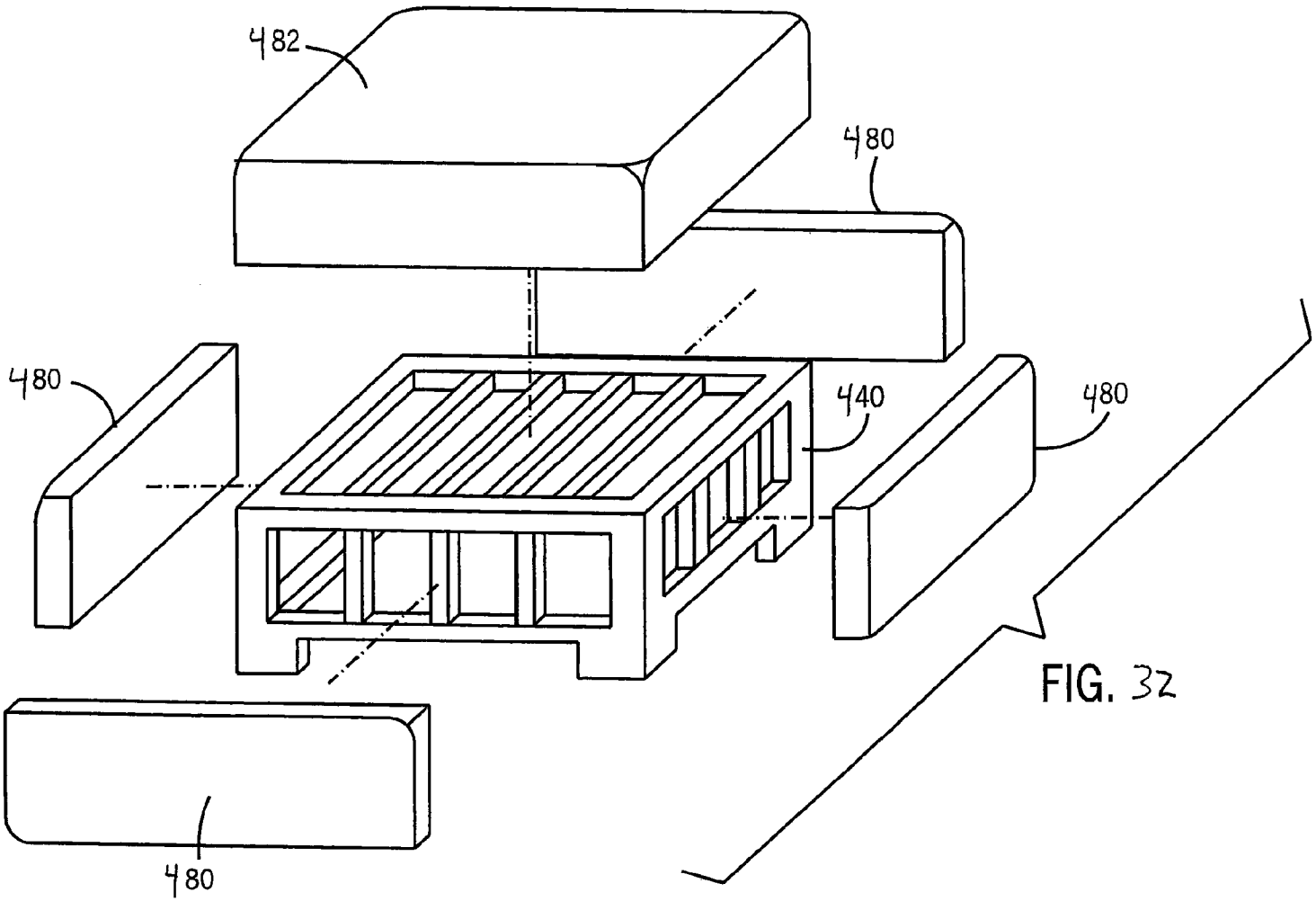
FIG. 32 illustrates the inner core support assembly with side and top pads.

Yet another embodiment of the inner core assembly is shown in FIG. 31. The inner core assembly 470 has a box frame 472 with integral legs or base supports 474 similar to inner core assembly 440. A plurality of vertical bars 476 connects between upper and lower bar components of box frame 472 on each side of the inner core assembly 470. A mesh or weave support pattern 478 connects to multiple points on the upper bar components of box frame 472.

The mesh or weave pattern 478 provides weight-bearing support for the horizontal top portion of the inner core assembly 470. The combination of box frame 472, vertical bars 476, and mesh or weave 478 provides the structural support of the inner core assembly 470. The mesh or weave pattern 478 can be made with cloth material or plastic or metal straps. As described for inner core assembly 440, back support bars 416 connect between box frame 472 and inner core assembly 447. The inner core assembly 470 is rigid to support the weight of one or more adult persons without noticeable bending or deformation. The structure of the inner core assembly 470 maintains its shape and rigidity beyond the useful service life of the sitting furniture.

The inner core assembly 440 is shown again in PIG. 32, although any one of the inner core assemblies described above could be used as well. The sides of inner core assembly 440 are covered with cloth pad or foam cushions 480. The cloth pad or foam cushion side coverings 480 may be 1-2 inches in thickness. A cloth pad or foam cushion top covering 482 is disposed over the horizontal top portion of the inner core assembly 440. In one embodiment, the cloth pad or foam cushion top covering 482 may be 5-6 inches in thickness. The top and side coverings are designed for comfort of the user.

In one embodiment, such as for sitting furniture 410 and 420, the structure of the sitting portion inner core assembly 440, side coverings 480, and top covering 482 are enclosed, at least on the sides and top, with a durable fabric material suitable for outside use. Likewise, the structure of the back support inner core assembly 447 and pad covering over the inner core assembly 447 are enclosed with a similar durable fabric material. Accordingly, the sitting portion inner core assembly and back support inner core assembly mentioned in FIG. 24 are illustrated and described in FIGS. 27-32. The exterior fabric provides a visually appealing and durable surface against outside elements. The exterior fabric also functions to hold the inner core assembly and cloth pads or foam cushions of the sitting portion and back support portion together as a tight assembly and single unit. The exterior fabric provides a protective covering which can withstand outside elements and be easily cleaned and maintained.

Figure 33:
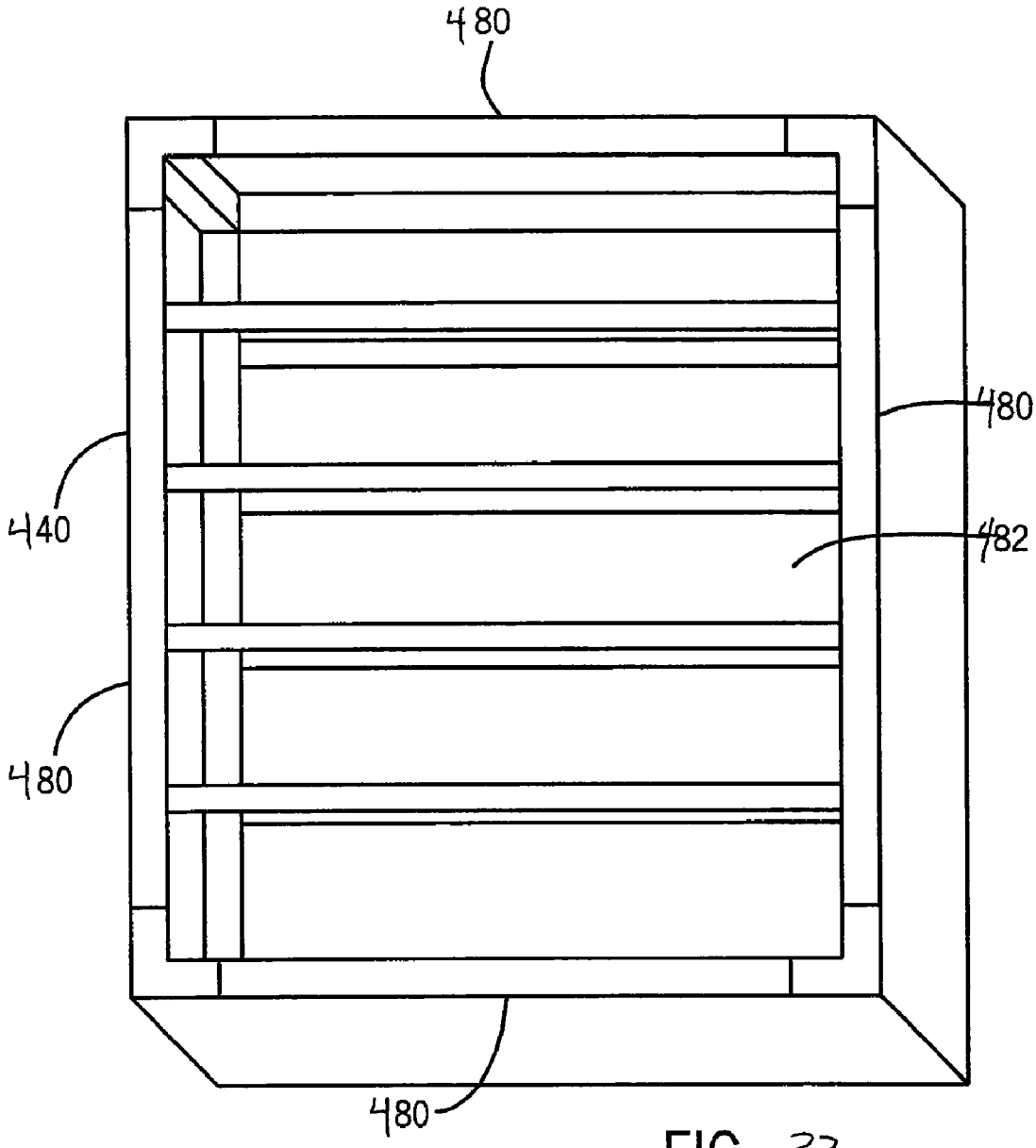
FIG. 33 is a bottom view of the sitting furniture with inner core support assembly and side and top pads.

In another embodiment, such as for sitting furniture 430, the inner core assembly 440 and padded cloth side coverings 480 are enclosed within a first durable exterior fabric material. The cloth pad or foam cushion top covering 482 is covered with a second durable exterior fabric material. The first and second exterior fabric coverings provide a visually appealing surface and functions to hold together the inner core assembly and/or cloth pads or foam cushions, as well as provide protective covering for furniture against outside elements. FIG. 33 shows a bottom side view of sitting furniture 410. The bottom side of sitting furniture 410 may be open as shown or covered with thin fabric material. The side covering 480 are disposed on each of the four sides of the inner core assembly 440. The top covering 482 is shown disposed over the top area of the inner core assembly 440.

While one or more embodiments of the present invention have been illustrated in detail, the skilled artisan will appreciate than modifications and adaptations to those embodiments may be made without departing from the scope of the present invention as set forth in the following claims.

What is claimed is:

1. A plurality of furniture units, comprising:

a first furniture unit having an irregular surface; and a second furniture unit having an irregular surface, the first and second furniture units each having a solo utilization, wherein the first and second furniture units have a joint utilization when the irregular surface of the first furniture unit is disposed in proximity to the irregular surface of the second furniture unit, wherein the first and second furniture units each include, (a) a first inner core assembly, (b) a padded covering disposed over a portion of the first inner core assembly, (c) a first fabric material disposed over at least the padded covering and the first inner core assembly, (d) a second inner core assembly for providing back support, the second inner core assembly being cylindrical in form with a plurality of horizontal bars disposed between circular end members, and (e) a back support bar connecting the first and second inner core assemblies.

2. The plurality of furniture units of claim 1, wherein the irregular surfaces of the first and second furniture units are contoured surfaces.

3. The plurality of furniture units of claim 1, further including a mechanical coupling mechanism for securing the first furniture unit to the second furniture unit.

4. The plurality of furniture units of claim 1, wherein the solo utilization of the first and second furniture units is to provide a first surface area.

5. The plurality of furniture units of claim 4, wherein the joint utilization of the first and second furniture units provides a second surface area which is larger than the first surface area.

6. An article of furniture, comprising first and second furniture units each having a solo utilization, the first and second furniture units having a joint utilization which differentiates from the solo utilizations of the first and second furniture units when the first furniture unit is disposed in proximity to the second furniture unit, the first and second furniture units each including, (a) a first inner core assembly, (b) a padded covering disposed over a portion of the first inner core assembly, (c) a first fabric material disposed over at least the padded covering and the first inner core assembly, (d) a second inner core assembly for providing back support, the second inner core assembly being cylindrical in form with a plurality of horizontal bars disposed between circular end members, and (e) a back support bar connecting the first and second inner core assemblies.

7. The article of furniture of claim 6, wherein the first and second furniture units each have an irregular surface.

8. The article of furniture of claim 7, wherein the irregular surfaces of the first and second furniture units are contoured surfaces.

9. The article of furniture of claim 8, wherein the contoured surface of the first furniture unit is brought into proximity of the contoured surface of the second furniture unit to provide a composite assembly of the first and second furniture units.

10. The article of furniture of claim 6, further including a mechanical coupling mechanism for securing the first furniture unit to the second furniture unit.

11. The article of furniture of claim 10, wherein the mechanical coupling mechanism connects a base of the first furniture unit to a base of the second furniture unit.

12. The article of furniture of claim 6, wherein the solo utilizations of the first and second furniture units is to provide a first surface area.

13. The article of furniture of claim 12, wherein the joint utilization of the first and second furniture units is to provide a second surface area which is larger than the first surface area.

14. The article of furniture of claim 13, wherein the second surface area is used for seating or table top.

15. The article of furniture of claim 6, wherein the solo utilization of the first furniture unit is to provide a seating surface area and the solo utilization of the second furniture unit is to provide a table top surface area.

16. A composite assembly of furniture units, comprising:

a first furniture unit having a solo utilization;

a second furniture unit having a solo utilization, wherein the first and second furniture units each include, (a) a first inner core assembly, (b) a padded covering disposed over a portion of the first inner core assembly, (c) a first fabric material disposed over at least the padded covering and the first inner core assembly, (d) a second inner core assembly for providing back support, the second inner core assembly being cylindrical in form with a plurality of horizontal bars disposed between circular end members, and (e) a back support bar connecting the first and second inner core assemblies; and means for combining the first and second furniture units to provide a joint utilization of the first and second furniture units which differentiates from the solo utilizations of the first and second furniture units.

17. The composite assembly of claim 16, wherein the first and second furniture units each have an irregular surface.

18. The composite assembly of claim 16, wherein the means for combining includes a mechanical coupling mechanism for securing the first furniture unit to the second furniture unit.

19. The composite assembly of claim 16, wherein the solo utilizations of the first and second furniture units is to provide a first surface area.

20. The composite assembly of claim 19, wherein the joint utilization of the first and second furniture units is to provide a second surface area which is larger than the first surface area.

21. A method of making an article of furniture, comprising:

providing a first furniture unit having a solo utilization;

providing a second furniture unit having a solo utilization, wherein the first and second furniture units each include, (a) a first inner core assembly, (b) a padded covering disposed over a portion of the first inner core assembly, (c) a first fabric material disposed over at least the padded covering and the first inner core assembly, (d) a second inner core assembly for providing back support, the second inner core assembly being cylindrical in form with a plurality of horizontal bars disposed between circular end members, and (e) a back support bar connecting the first and second inner core assemblies; and providing a joint utilization of the first and second furniture units which differentiates from the solo utilizations of the first and second furniture units when the first furniture unit is disposed in proximity to the second furniture unit.

22. The method of claim 21, further including providing the first and second furniture units with an irregular surface.

23. The method of claim 21, further including providing a mechanical coupling mechanism for securing the first furniture unit to the second furniture unit.

24. The method of claim 21, wherein the solo utilizations of the first and second furniture units is to provide a first surface area.

25. The method of claim 24, wherein the joint utilization of the first and second furniture units is to provide a second surface area which is larger than the first surface area.

* * * * *